US008623248B2

(12) United States Patent
Wahal et al.

(10) Patent No.: US 8,623,248 B2
(45) Date of Patent: Jan. 7, 2014

(54) METHODS FOR PRODUCING NONWOVEN MATERIALS FROM CONTINUOUS TOW BANDS

(75) Inventors: Sanjay Wahal, Appleton, WI (US); Edward J. Clark, Pearisburg, VA (US); Ray Robertson, Blacksburg, VA (US); Jeffrey Scott Conley, Narrows, VA (US)

(73) Assignee: Celanese Acetate LLC, Irving, TX (US)

( * ) Notice: Subject to any disclaimer, the term of this patent is extended or adjusted under 35 U.S.C. 154(b) by 0 days.

(21) Appl. No.: 13/297,787

(22) Filed: Nov. 16, 2011

(65) Prior Publication Data

US 2013/0122770 A1 May 16, 2013

(51) Int. Cl.

| | |
|---|---|
| ***D01F 1/02*** | (2006.01) |
| ***D02G 3/24*** | (2006.01) |
| ***D04H 3/02*** | (2006.01) |

(52) U.S. Cl.

USPC ..... 264/103; 28/220; 28/283; 264/211; 264/555

(58) Field of Classification Search

USPC ..... 264/103, 211, 555; 28/219, 220, 283

See application file for complete search history.

(56) References Cited

U.S. PATENT DOCUMENTS

| | | | |
|---|---|---|---|
| 2,794,480 | A | 6/1957 | Crawford et al. |
| 2,908,045 | A | 10/1959 | Stevens |
| 3,017,309 | A | 1/1962 | Crawford et al. |
| 3,032,829 | A | 5/1962 | Mahoney et al. |
| 3,050,430 | A | 8/1962 | Gallagher |
| 3,079,663 | A | 3/1963 | Dyer et al. |
| 3,081,951 | A | 3/1963 | Dyer et al. |
| 3,095,343 | A | 6/1963 | Berger |
| 3,099,594 | A | 7/1963 | Caines et al. |
| 3,156,016 | A | 11/1964 | Dunlap et al. |
| 3,226,773 | A | 1/1966 | Paliyenko |
| 3,258,823 | A | 7/1966 | Stevens et al. |
| 3,262,178 | A | 7/1966 | Aspy et al. |
| 3,262,181 | A | 7/1966 | Hawkins et al. |
| 3,281,913 | A | 11/1966 | Morehead et al. |
| 3,282,768 | A | 11/1966 | Caines et al. |
| 3,297,506 | A | 1/1967 | Pannill et al. |
| 3,402,446 | A | 9/1968 | Benson |
| 3,413,698 | A | 12/1968 | Fritz et al. |

(Continued)

FOREIGN PATENT DOCUMENTS

| | | |
|---|---|---|
| EP | 0 357 257 A1 | 3/1990 |
| EP | 1096047 A1 | 5/2001 |

(Continued)

OTHER PUBLICATIONS

International Search Report and Written Opinion for PCT/US2012/064987 dated Apr. 1, 2013.

(Continued)

*Primary Examiner* — Leo B Tentoni

(74) *Attorney, Agent, or Firm* — McDermott Will & Emery LLP

(57) ABSTRACT

A system may include a plurality of tow band processing lines and a master air jet in communication with the tow band processing lines to receive a plurality of processed tow bands from the tow band processing lines to form a bulked web. The system may be used to form a bulked web that itself is a nonwoven material or that may be further processed into a nonwoven material.

25 Claims, 18 Drawing Sheets

(56) References Cited

U.S. PATENT DOCUMENTS

| | | | | |
|---|---|---|---|---|
| 3,525,134 | A | 8/1970 | Coon | |
| 3,535,745 | A | 10/1970 | Zeidman | |
| 3,623,935 | A | 11/1971 | Allman et al. | |
| 3,645,431 | A | 2/1972 | Harrison | |
| 3,730,824 | A | 5/1973 | Watson | |
| 3,745,617 | A | 7/1973 | Smith, Jr. | |
| 3,766,606 | A | 10/1973 | Piper et al. | |
| 3,795,944 | A | 3/1974 | Daniels | |
| 3,805,343 | A | 4/1974 | Ethridge | |
| 3,831,501 | A | 8/1974 | Bevington, Jr. | |
| 3,960,645 | A | 6/1976 | Brackmann et al. | |
| 4,259,400 | A * | 3/1981 | Bolliand | 442/392 |
| 4,259,769 | A | 4/1981 | Greve et al. | |
| 4,340,563 | A | 7/1982 | Appel et al. | |
| 4,435,239 | A | 3/1984 | Harris | |
| 4,468,845 | A | 9/1984 | Harris | |
| 4,472,224 | A | 9/1984 | Pryor | |
| 4,522,616 | A | 6/1985 | Hyde et al. | |
| 4,541,825 | A | 9/1985 | Hyde et al. | |
| 5,060,351 | A | 10/1991 | Street | |
| 5,203,757 | A | 4/1993 | Kampen | |
| 5,282,779 | A | 2/1994 | Sakai et al. | |
| 5,294,478 | A | 3/1994 | Wanek et al. | |
| 5,331,976 | A | 7/1994 | St. Pierre | |
| 5,387,208 | A | 2/1995 | Ashton et al. | |
| 5,531,728 | A | 7/1996 | Lash | |
| 5,579,566 | A | 12/1996 | Burkhardt et al. | |
| 5,582,603 | A | 12/1996 | Difilippantonio et al. | |
| 5,591,297 | A | 1/1997 | Ahr | |
| 5,833,678 | A | 11/1998 | Ashton et al. | |
| 5,876,388 | A | 3/1999 | McDowall et al. | |
| 6,068,620 | A | 5/2000 | Chmielewski | |
| 6,103,953 | A | 8/2000 | Cree et al. | |
| 6,231,555 | B1 | 5/2001 | Lynard et al. | |
| 6,245,961 | B1 | 6/2001 | Roxendal et al. | |
| 6,253,431 | B1 | 7/2001 | Ames et al. | |
| 6,319,239 | B1 | 11/2001 | Daniels et al. | |
| 6,417,427 | B1 | 7/2002 | Roxendal et al. | |
| 6,455,753 | B1 | 9/2002 | Glaug et al. | |
| 6,506,873 | B1 | 1/2003 | Ryan et al. | |
| 6,509,513 | B2 | 1/2003 | Glaug et al. | |
| 6,511,566 | B1 | 1/2003 | Wessel et al. | |
| 6,543,106 | B1 | 4/2003 | Ames et al. | |
| 6,566,578 | B1 | 5/2003 | Glaug et al. | |
| 6,572,602 | B2 | 6/2003 | Furuya et al. | |
| 6,613,704 | B1 | 9/2003 | Arnold et al. | |
| 6,626,879 | B1 | 9/2003 | Ashton et al. | |
| 6,641,695 | B2 | 11/2003 | Baker | |
| 6,660,902 | B2 | 12/2003 | Widlund et al. | |
| 6,888,045 | B2 | 5/2005 | Wahlstrom et al. | |
| 6,923,926 | B2 | 8/2005 | Walter et al. | |
| 6,998,512 | B2 | 2/2006 | Wahlstrom et al. | |
| 7,003,856 | B2 | 2/2006 | Hayashi et al. | |
| 7,045,030 | B2 | 5/2006 | Bevins, III et al. | |
| 7,074,215 | B2 | 7/2006 | Ashton et al. | |
| 7,138,561 | B2 | 11/2006 | Fuchs et al. | |
| 7,195,685 | B2 | 3/2007 | Bevins, III et al. | |
| 7,232,300 | B2 | 6/2007 | Walter et al. | |
| 7,759,540 | B2 | 7/2010 | Litway et al. | |
| 7,767,598 | B2 | 8/2010 | Schneider et al. | |
| 7,771,405 | B2 | 8/2010 | Andersson et al. | |
| 7,785,307 | B2 | 8/2010 | Wennerback | |
| 7,786,341 | B2 | 8/2010 | Schneider et al. | |
| 7,825,291 | B2 | 11/2010 | Elfsberg et al. | |
| 7,833,447 | B2 | 11/2010 | Dahringer et al. | |
| 7,850,672 | B2 | 12/2010 | Guidotti et al. | |
| 7,867,208 | B2 | 1/2011 | Samuelsson et al. | |
| 7,875,136 | B2 | 1/2011 | Torstensson et al. | |
| 7,888,549 | B2 | 2/2011 | Jansson et al. | |
| 8,013,207 | B2 | 9/2011 | Dovertie | |
| 8,029,487 | B2 | 10/2011 | Bagger-Sjoback et al. | |
| 8,057,457 | B2 | 11/2011 | Back et al. | |
| 2003/0034115 | A1 | 2/2003 | Barth et al. | |
| 2003/0162460 | A1 * | 8/2003 | Saka et al. | 264/171.1 X |
| 2004/0058607 | A1 | 3/2004 | Bodaghi | |
| 2005/0147711 | A1 | 7/2005 | Walter et al. | |
| 2006/0247587 | A1 | 11/2006 | Ponomarenko et al. | |
| 2008/0113574 | A1 | 5/2008 | Neron et al. | |
| 2009/0036016 | A1 | 2/2009 | Robertson et al. | |
| 2009/0287131 | A1 | 11/2009 | Neron et al. | |

FOREIGN PATENT DOCUMENTS

| | | | |
|---|---|---|---|
| JP | 07-49611 | | 2/1995 |
| JP | 3486905 | B2 | 1/2004 |
| KR | 1019890018242 | | 12/1989 |
| WO | WO 83/03267 | A | 9/1983 |
| WO | WO 99/30661 | A1 | 6/1999 |
| WO | 2013074591 | A1 | 5/2013 |

OTHER PUBLICATIONS

International Search Report and Written Opinion for PCT/US2012/064962 dated Mar. 29, 2013.

* cited by examiner

METHODS FOR PRODUCING NONWOVEN MATERIALS FROM CONTINUOUS TOW BANDS

BACKGROUND

The present invention relates to nonwoven materials produced from continuous tow bands, and to apparatuses, systems, and methods related thereto.

Nonwoven material is a term of art that refers to a manufactured sheet, batting, webbing, or fabric that is held together by various methods. Those methods include, for example, fusion of fibers (e.g., thermal, ultrasonic, pressure, and the like), bonding of fibers (e.g., resins, solvents, adhesives, and the like), and mechanical entangling (e.g., needle-punching, hydroentangling, and the like). The term is sometimes used broadly to cover other structures such as those held together by interlacing of yarns (stitch bonding) or those made from perforated or porous films. The term excludes woven, knitted, and tufted structures, paper, and felts made by wet milling processes.

Nonwoven materials can be produced from carding processes that convert bales of staple fibers into mats that are needlepunched or hydroentangled to produce the nonwoven materials. Staple fibers are finite in length (approximately 7 centimeters in length) that during carding are spread into a uniform web. In the final steps of carding, a resin bonding treatment is typically included to enhance the robustness of the final nonwoven material, e.g., making the nonwoven material durable to washing.

During the carding process, staple fibers which are shorter may not be able to be carded by the carding apparatus and drop to the floor thereby creating waste. In some instances, recycling of the shorter stable fibers is performed to minimize waste.

Further, during the carding process, stable fibers may become airborne thereby increasing mechanical problems and health risk. Airborne fibers may collect in the equipment leading to increased maintenance and possible downtime. Further, airborne fibers pose inhalation and dermal irritation risks to workers.

Because of the significant investment in capital equipment for carding and health issues associated with processing bales of staple fiber, the production of nonwoven materials from tow bands has been of interest to one skilled in the art. As used herein, the terms "continuous tow band" and "tow band" may be used interchangeably to refer to a collection of continuous (e.g., indefinite or extreme length) fiber filaments without defined twist usually held together with a crimp and/or tackifier. It should be noted that tow bands may be of any cross-sectional shapes including, but not limited to, circular, substantially circular, ovular, substantially ovular, rectangular, substantially rectangular, planar, and substantially planar.

Producing nonwoven materials from continuous tow bands potentially increases the production speed of nonwoven materials in two ways. First, tow bands can be processed on the order of 650 meters per minute while bales of staple fibers can be run at a max speed of about 400 meters per minute. Second, bales of tow bands have more material than bales of staple fibers, which reduces the frequency of switch bales relative to the production volume of nonwoven materials. However, tow bands are typically produced with maximum widths of about 15 cm to about 60 cm depending on the composition of the tow band filaments. As some nonwoven materials need to be produced with widths of meters, the use of tow bands for the production of nonwovens has been limited.

Apparatuses to bring together tow bands to produce nonwoven materials similar in width to nonwoven material produced by carding would be of benefit to one skilled in the art for a plurality of reasons.

SUMMARY OF THE INVENTION

The present invention relates to nonwoven materials produced from continuous tow bands, and to apparatuses, systems, and methods related thereto.

In some embodiments, the present invention provides a method that comprises producing a bulked web from a plurality of processed tow bands; and forming a nonwoven material from the bulked web.

In some embodiments, the present invention provides a system that comprises a plurality of tow band processing lines; and a master air jet in communication with the tow band processing lines to receive a plurality of processed tow bands from the tow band processing lines to form a bulked web.

In other embodiments, the present invention provides a method that comprises processing a plurality of tow bands along at least one tow band processing line to form a plurality of processed tow bands; and combining the plurality of processed tow bands using a master air jet to form a bulked web.

In some embodiments, the present invention provides a method that comprises forming a plurality of processed tow bands along a plurality of tow band processing lines; combining the plurality of processed tow bands to form a bulked web with a master air jet; transporting the bulked web to a nonwoven manufacturing line; and producing a nonwoven material from the bulked web.

In still other embodiments, the present invention provides a nonwoven material that comprises a needleloomed bulked web comprising a plurality of entangled tow bands.

In other embodiments, the present invention provides a nonwoven material that comprises a hydroentangled bulked web comprising a plurality of entangled tow bands.

In some embodiments, the present invention provides a master air jet that comprises an inlet opening to a central passageway, the inlet opening having a width of about 5 cm to about 10 m and a height of about 0.5 cm to about 5 cm; an air jet capable of forming a Venturi in central passageway; a forming chamber along the central passageway disposed after the air jet; an accumulation chamber formed by at least two perforated plates and at least two side plates, the accumulation chamber being disposed along the central passageway after the forming chamber; and an outlet opening to the central passageway, the outlet opening having a width of about 5 cm to about 10 m and a height of about 2 mm to about 500 mm.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to nonwoven materials produced from continuous tow bands, and to apparatuses, systems, and methods related thereto.

The systems described herein enable the production of nonwoven materials from continuous tow bands. In some embodiments, the systems are capable of combining tow bands to ultimately produce nonwoven materials with widths many times the width of an individual tow band, e.g., 25 times the width of an individual tow band. The systems advantageously may require less capital investment in equipment, in most cases less than half the investment of traditional carding systems, and may be integrated with other processes and equipment for downstream nonwoven processing (e.g., hydroentanglement or needlelooming). Additionally, the systems of the present invention may, in some embodiments, be configured to produce nonwoven materials with layered or complex compositions at the point of integration of the mat, which in carding processes are produced by combining nonwoven materials as opposed to while the nonwoven materials are being produced.

Utilizing tow bands may also be advantageous in the processing speed and efficiency, in that, bales of tow bands are often more densely packed than staple fiber bales thereby yielding more nonwoven material per bale using tow band bales. Additionally, tow band processing is faster than staple fiber processing. Together, these increase both speed and efficiency of manufacturing nonwoven materials. Further, the utilization of continuous tow bands may provide advantages by reducing waste, reducing processing steps (e.g., eliminating resin bonding), reducing the risk of mechanical problems, and reducing health risks to workers all of which are typically associated with the production of nonwoven materials using carding.

Figure 1A:
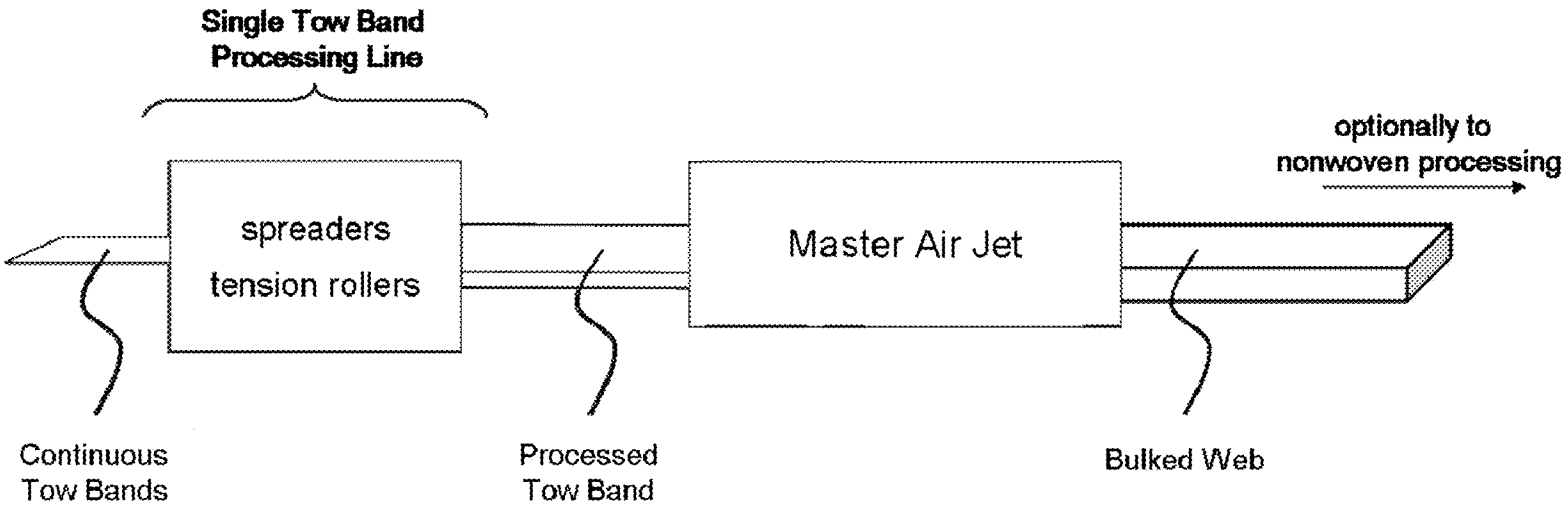
FIGS. 1A-C illustrate nonlimiting examples of systems according to the present invention for producing bulked webs from tow bands.
Figure 1B:
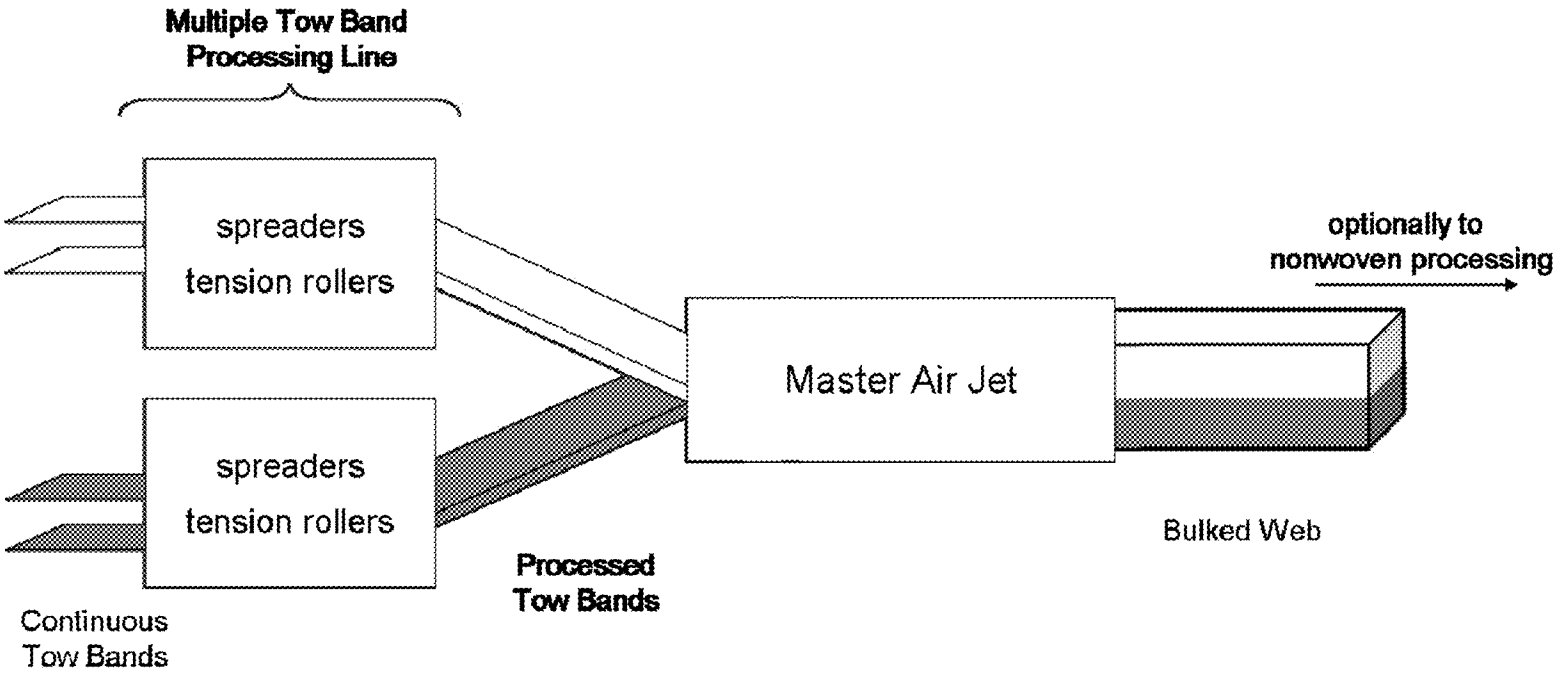
Figure 1C:
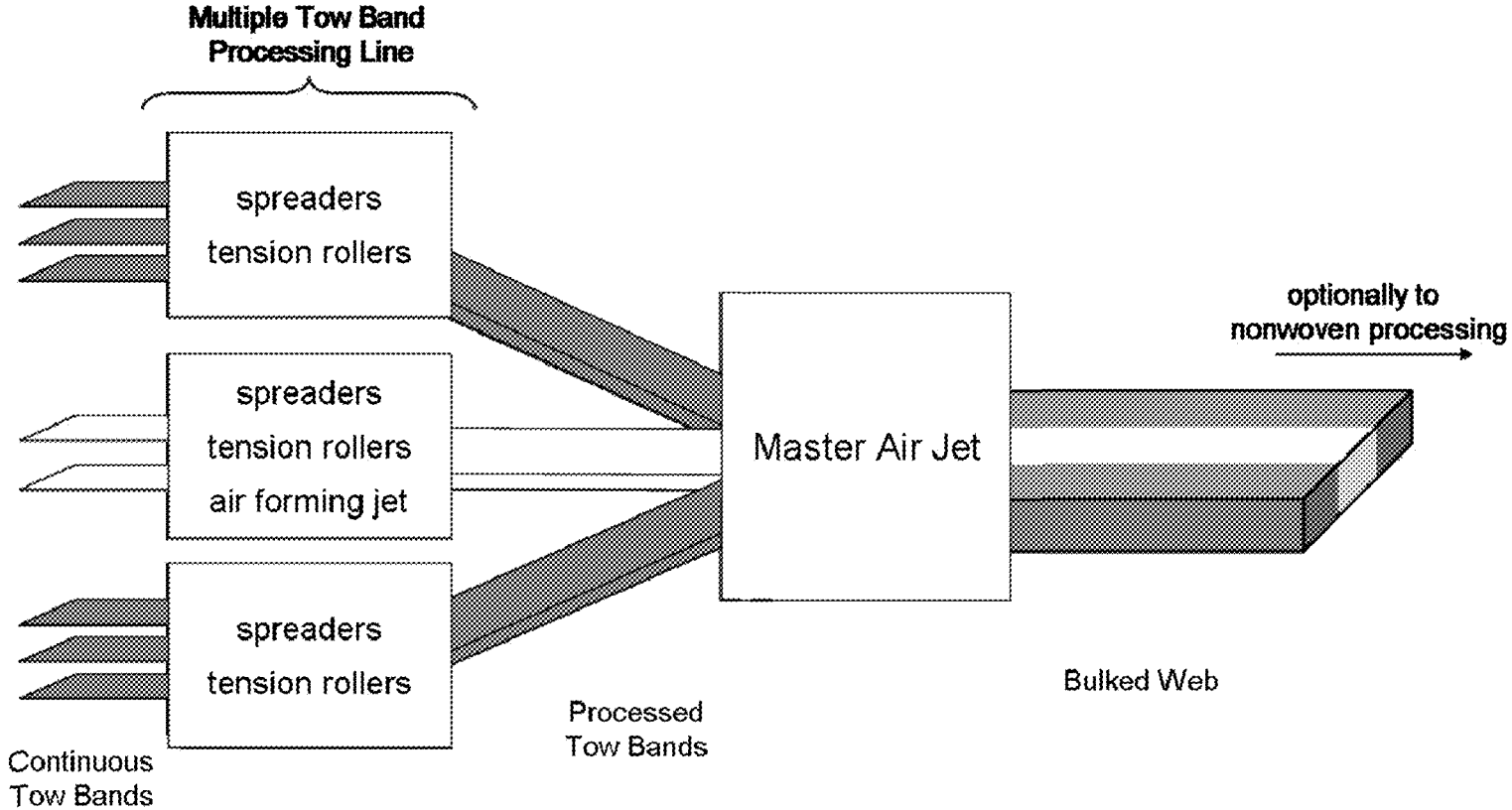

In some embodiments, the systems of the present invention for producing bulked webs from tow bands may comprise at least one tow band processing line operably connected to at least one master air jet to receive processed tow bands from the tow band processing lines, nonlimiting examples of which are illustrated in FIGS. 1A-1C. In some embodiments, the systems of the present invention for producing bulked webs from tow bands may comprise at least one tow band processing line and at least one master air jet, nonlimiting examples of which are illustrated in FIGS. 1A-1C. In some embodiments, a system may have six or more tow band processing lines and two or more master air jets (in parallel and/or in series).

One skilled in the art, with the benefit of this disclosure, will recognize the apparatuses or machinery capable for properly transporting the continuous tow bands, processed tow bands, and bulked webs to, between, and/or from the tow band processing lines, the master air jet, and any additional processing areas or lines (e.g., collection areas, additive application areas, nonwoven manufacturing lines, product manufacturing lines, and the like). By way of nonlimiting examples, suitable apparatuses and/or machinery may include guides, rollers, reels, gears, conveyors, transfer belts, vacuums, air jets, and the like, any hybrid thereof, or any combination thereof. In some embodiments, systems may include a conveyor for transporting a bulked web to nonwoven manufacturing lines.

Master air jets generally use an air jet to create a Venturi that moves processed tow bands through the master air jet apparatus. The Venturi may further act to entangle filaments of adjacent processed tow bands as they pass through the master air jet. In some embodiments, the master air jet of the present invention may be configured to received a plurality of processed tow bands. In some embodiments, the master air jet of the present invention may be configured to produce bulked webs produced from tow bands where the bulked webs have calipers and/or complex cross-sectional make-ups not previously realized. In some embodiments, the increased caliper and/or possibility of complex cross-sectional make-ups of the bulked webs of the present invention may enable the production of nonwoven materials not previous realized when produced from tow bands.

Referring now to FIGS. 4-9, nonlimiting examples of master air jets of the present invention and components thereof, master air jet 440 may include housing 442 that generally is formed by a pair of side plates 474, top plate 480, and bottom plate 482. It should be noted that side, top, and bottom to modify the plates are used for simplicity in describing the master air jet and should not be taken to be limiting as to the relation of the master air jet to the plane of the ground. The pair of side plates 474 may be operably attached to the top plate 480 and bottom plate 482 with bolts at sizing guides 478.

Figure 7:
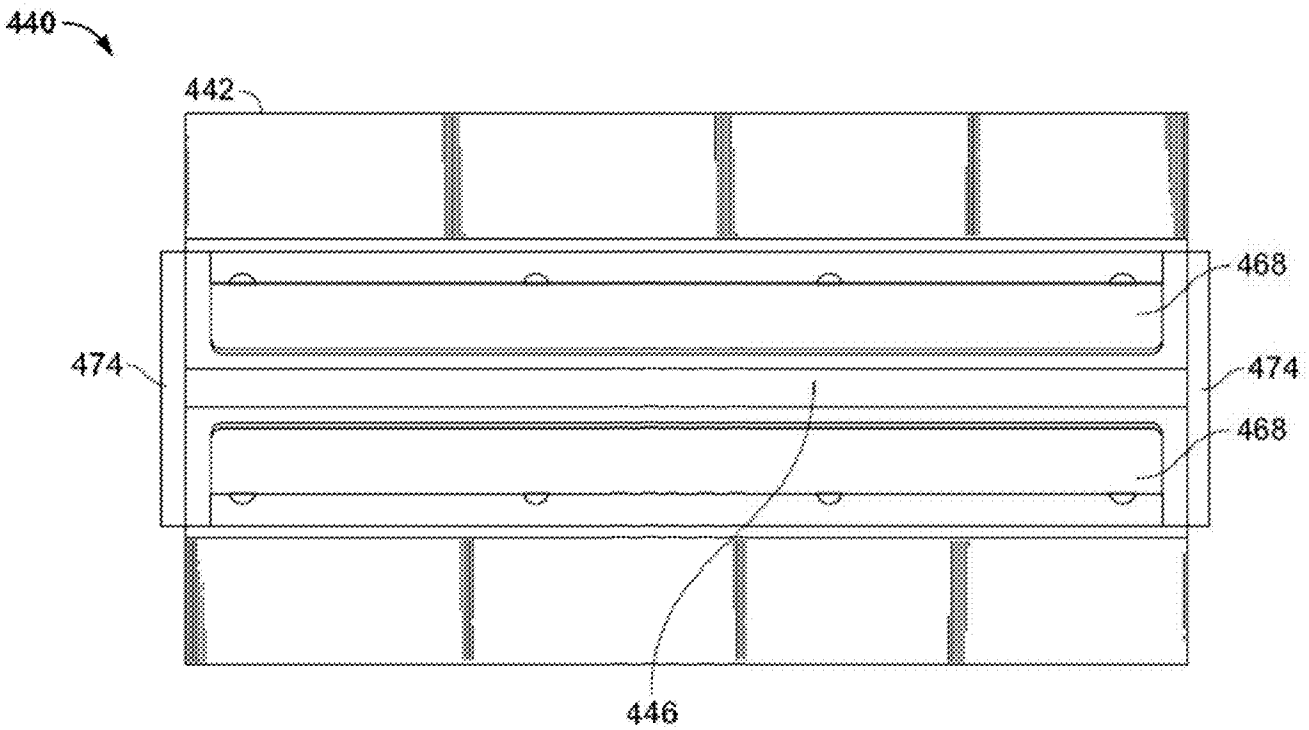
FIG. 7 illustrates an end view illustrating the outlet opening in the housing of a nonlimiting example of a master air jet of the present invention for use in conjunction with the systems of the present invention.
Figure 8A:
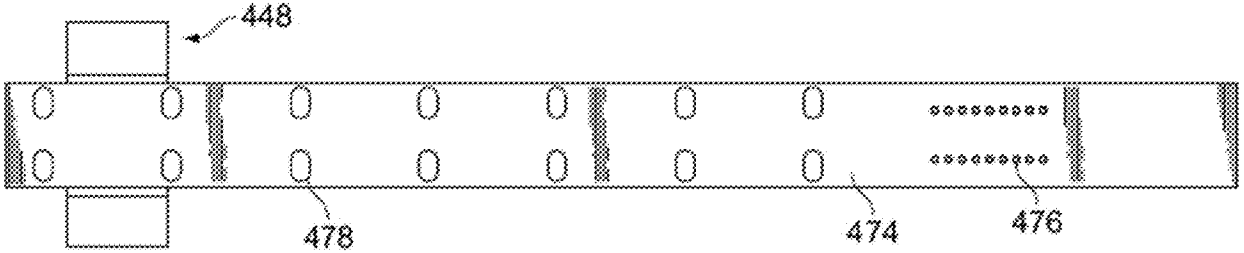
FIGS. 8A-B illustrate a view of two different embodiments of the side plates of the housing of a nonlimiting example of a master air jet of the present invention for use in conjunction with the systems of the present invention.
Figure 8B:
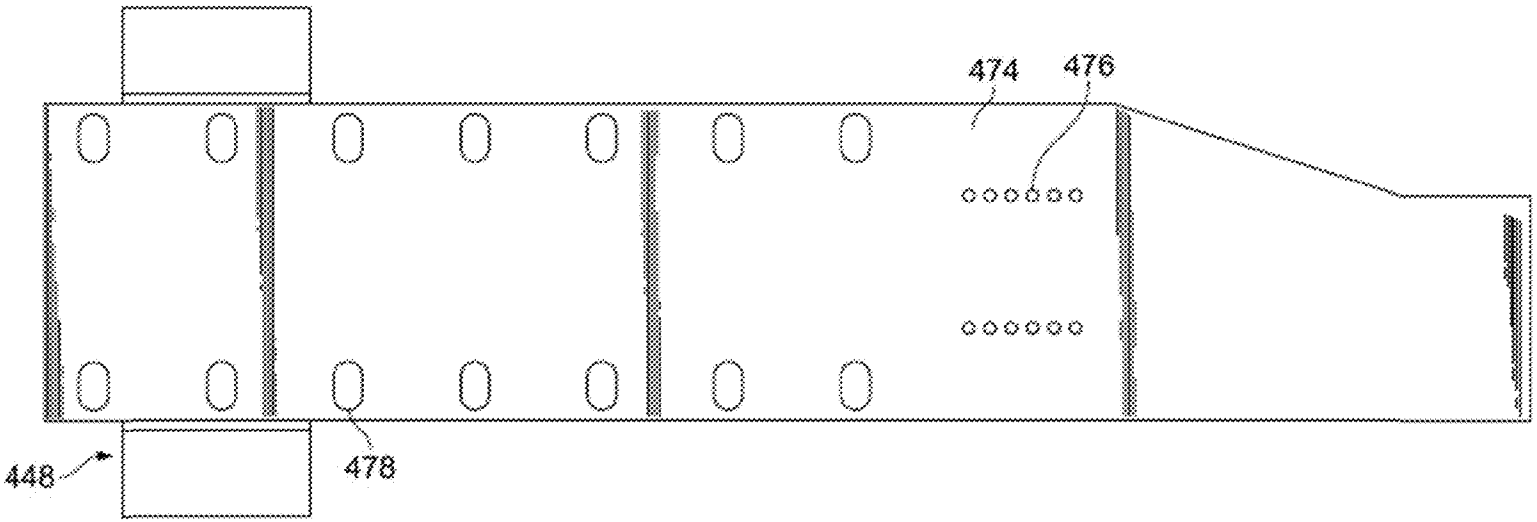
Figure 9:
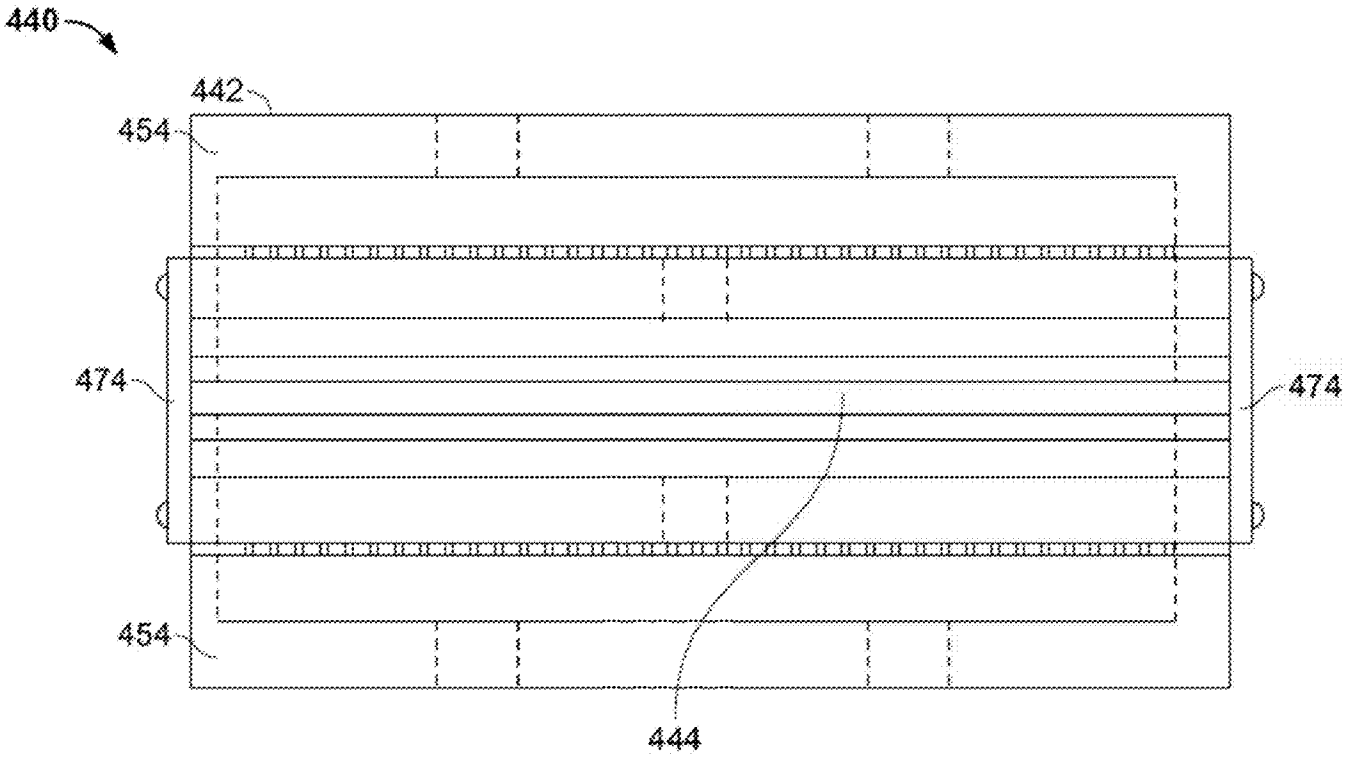
FIG. 9 illustrates an end view of the inlet opening of the housing of a nonlimiting example of a master air jet of the present invention for use in conjunction with the systems of the present invention.

At one end, master air jet 440 includes inlet opening 444. As best seen as an example in FIG. 9, inlet opening 444 may have a generally rectangular configuration that corresponds generally to the shape of the continuous tow band which is received in inlet opening 444. Housing 442 also includes outlet opening 446 which, as best seen in FIG. 7, may also have a rectangular configuration that corresponds to the desired shape of the processed tow band leaving master air jet 440.

Figure 5:
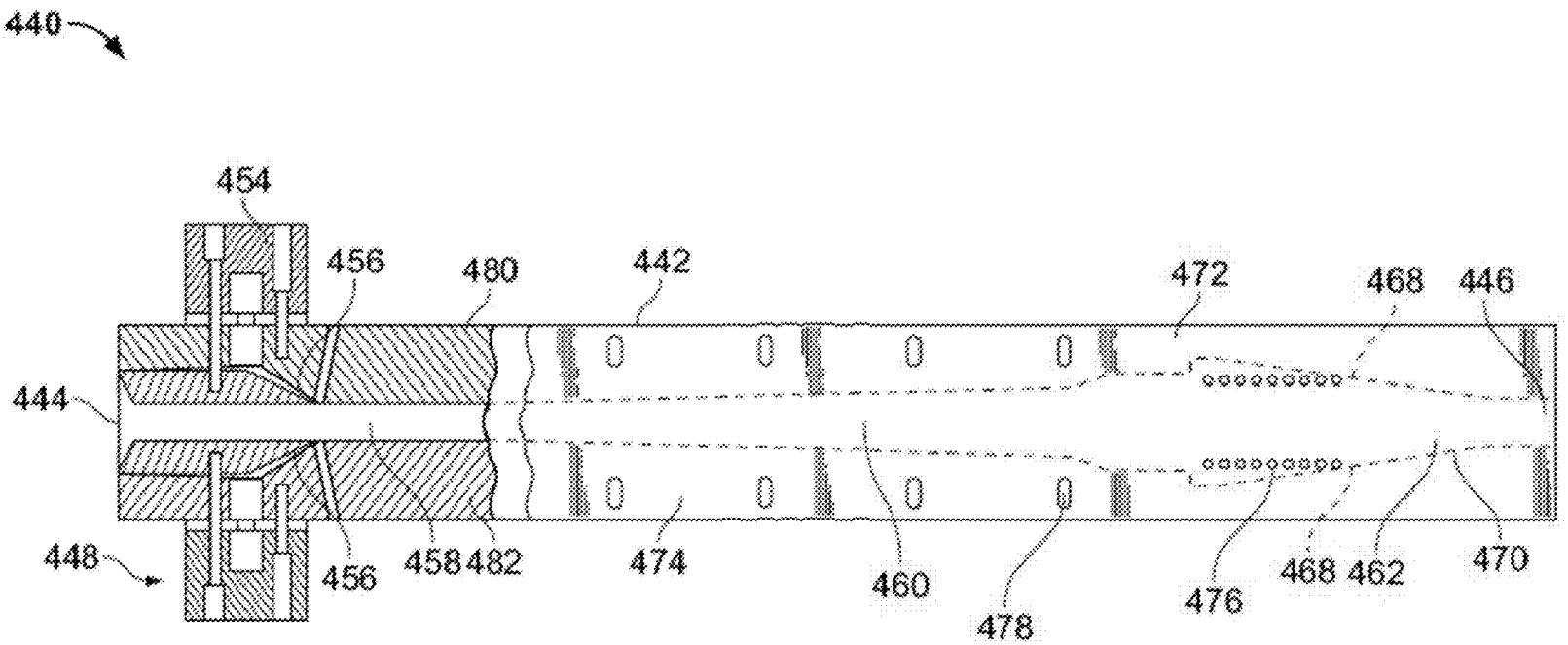
FIG. 5 illustrates a side view, partially in section, of a nonlimiting example of a master air jet of the present invention for use in conjunction with the systems of the present invention.

Air jet 448 may be formed adjacent the inlet end of housing 442 and may include a source of compressed air (or other fluid in some embodiments) and a conventional control valve for regulating the flow of compressed air from the compressed air source to air manifold 454 through which the compressed air is delivered to jet orifices 456. Jet orifices 456 may form a conventional jet of air for moving the continuous tow band through central passageway 458 in housing 442 as will be explained in greater detail herein. As best seen in FIG. 5, passageway 458 has a gradually increasing cross-sectional area in the direction of movement of the continuous tow band so as to provide forming chamber 460 downstream of air jet 448. Forming chamber 460 may also preferably have a generally rectangular configuration that corresponds to the rectangular shape of the processed tow bands.

Accumulating chamber 462 may be located adjacent the outlet end of housing 442 and downstream of forming chamber 460 and may have a vertical dimension which is greater than outlet opening 446 of forming chamber 460. Accumulating chamber 462 may also be preferably formed with a rectangular configuration to permit the continuous tow band to pass into accumulating chamber 462 from forming chamber 460 to accumulate within accumulating chamber 462. Ultimately the processed tow bands may be withdrawn from housing 442 through outlet opening 446 at different flow rates yielding a bulked web.

Figure 6:
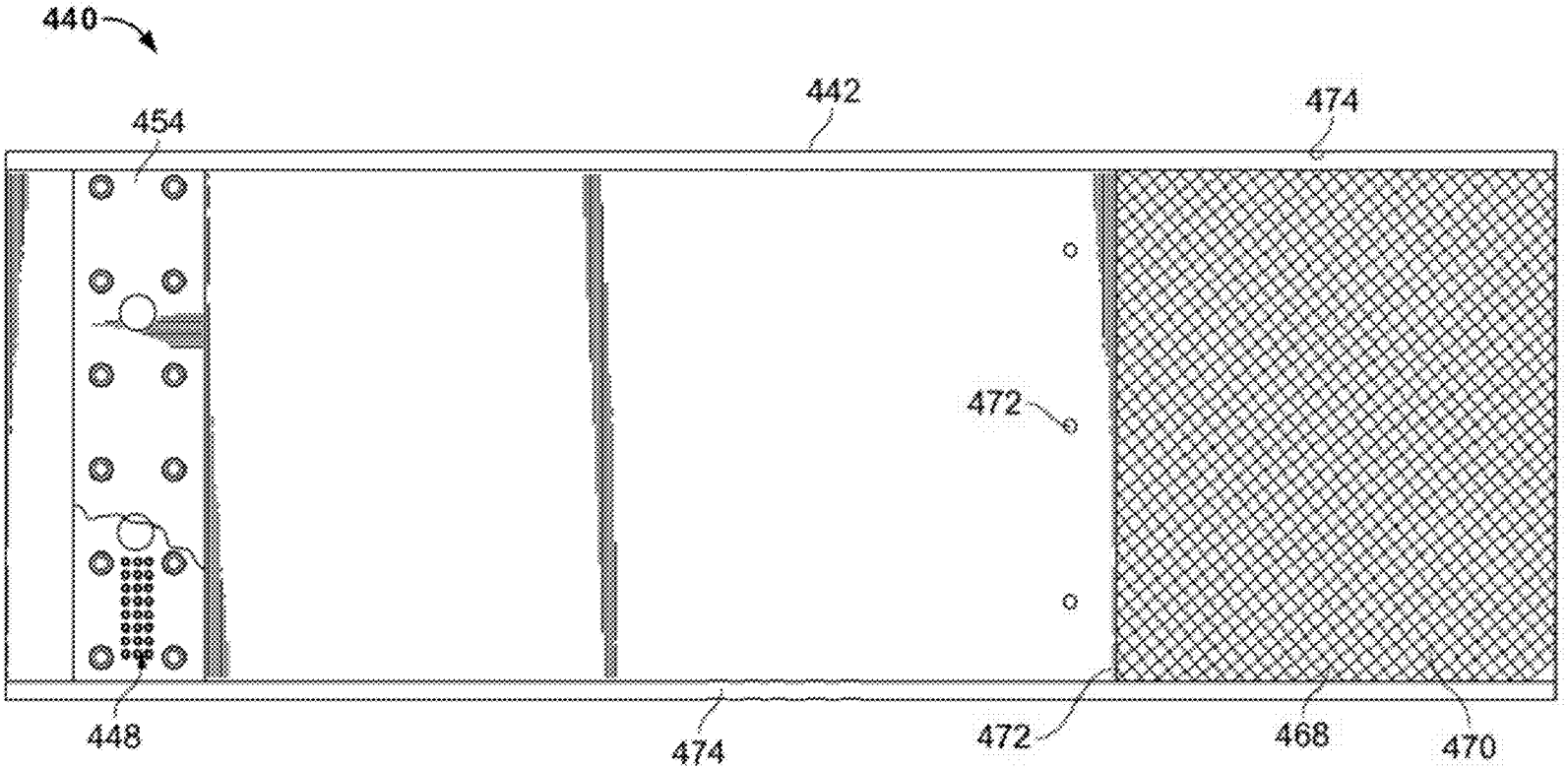
FIG. 6 illustrates a plane view of the housing of a nonlimiting example of a master air jet of the present invention for use in conjunction with the systems of the present invention.

As best seen in FIGS. 5 and 6, a pair of perforated plates 468, each having a large number of perforations 470 therein, may be disposed in accumulating chamber 462 and in side plates 474 between forming chamber 460 and accumulating chamber 462. Perforated plates 468 may be fixed in place to top plate 480 and bottom plate 482 by a plurality of bolts 472 that maintain perforated plates 468 in fixed positions to form accumulating chamber 462.

The size of forming chamber 460 and accumulating chamber 462 may be involved in determining the caliper of the bulked web produced from master air jet 440. Sizing guides 478 along side plates 474 allow for increasing or decreasing the size of forming chamber 460. It should be noted that the configuration of sizing guides 478 along side plates 474 may allow for changing the size of forming chamber 460 by different amounts by angling top plate 480 relative to bottom plate 482. Varying the shape and/or positions of perforated plates 468 the size of accumulating chamber 462 may be varied.

Similarly, the size of inlet opening 444 and outlet opening 446 may be adjusted using sizing guides 478 along side plates 474 or varying the position and/or shape of perforated plates 468. Variable sizing of inlet opening 444 may advantageously allow for receiving higher caliper processed tow bands into master air jet 440. Also variable sizing of outlet opening 446 may advantageously allow for producing higher caliper bulked webs.

Side plates 474 may also have a plurality of perforations 476 located generally at a position where the carrier air leaves forming chamber 460 and enters accumulating chamber 462, whereby some of the carrier air can be discharged through perforations 476.

In the operation of master air jet 440, compressed air flows to air jet 448 at a flow rate controlled by the control valve, and the jet of air formed by orifices 456 may move the continuous tow band through forming chamber 460. As the processed tow band moves through forming chamber 460 by the carrier air, the carrier air may at least partially bulk the processed tow band so that it gradually increases in cross-sectional area in conformity with the gradually increasing cross-sectional area of forming chamber 460. When the processed tow band exits forming chamber 460 and enters accumulating chamber 462, the processed tow band bulks even further to correspond to the vertical distance between the upstream ends of perforated plates 468 (see FIG. 5).

While some of the carrier air may be discharged through perforations 476 in side plates 474, a substantial portion of the carrier air moves the processed tow band through the spacing between perforated plates 468 and passes outwardly through perforations 470 in perforated plates 468. In so doing, the air passing outwardly through perforations 470 urges the processed tow band into frictional engagement with the facing inner surfaces of perforated plates 468. This frictional engagement creates a braking action on the processed tow band which should retard the movement of the processed tow band through accumulating chamber 462 and causes the tow to accumulate in accumulating chamber 462 at a density greater than the processed tow band had in forming chamber 460, after which the bulked and densified processed tow band exits the accumulating chamber 462 as a bulked web through the outlet opening 446 at different flow rates.

The flow rate of the carrier air may determine the retarding or braking action applied to the continuous tow band as it passes between perforated plates 468. If the flow rate of the carrier air is increased, the carrier air passing outwardly through perforations 470 in perforated plates 468 will urge the processed tow band into engagement with perforated plates 468 with a greater force, and may thereby increase the retarding or braking action that is applied to the processed tow band. Conversely, if the flow rate of the carrier air is decreased, there will be a smaller braking action applied to the processed tow band. Therefore, virtually infinite regulation of the braking action may be obtained by the simple expedient of operating the control valve to provide a flow of carrier air that provides the desired braking action imposed on the processed tow band, and thereby should control the density and caliper of the bulked web as it leaves housing 442.

In some embodiments, master air jets of the present invention may having hinged side plates. Hinged side plates may advantageously allow for physically pulling processed tow bands through the master air jet then closing the hinged side plates with the air jets operating so as to create the Venturi that then operates to transport the processed tow bands through the master air jet. By way of nonlimiting example, the ability to physically start the movement of the processed tow bands through the master air jet may be needed with high denier and high denier per filament processed tow bands.

Figure 10:
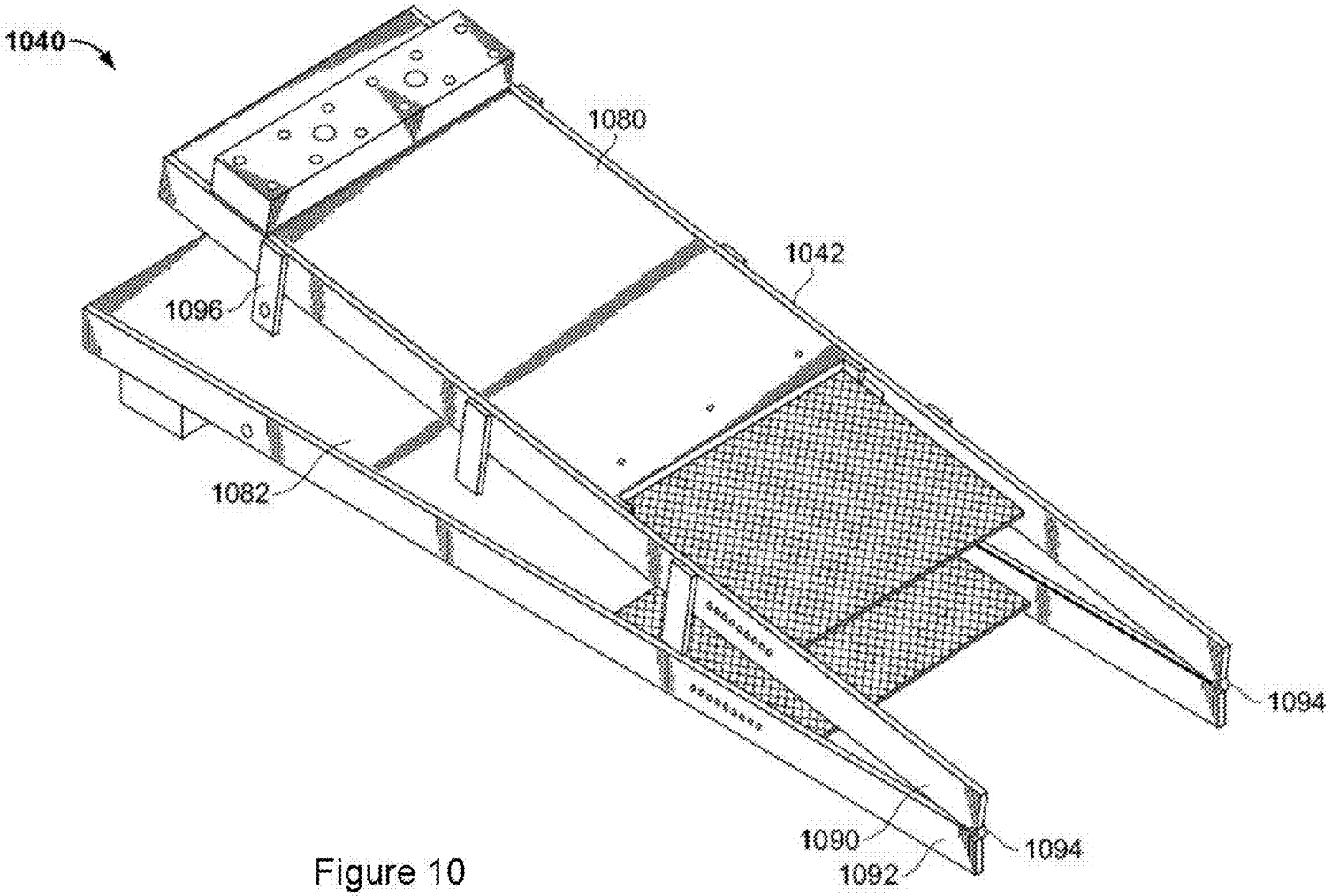
FIG. 10 illustrates a perspective view of a nonlimiting example of a master air jet of the present invention for use in conjunction with the systems of the present invention.
Figure 11:
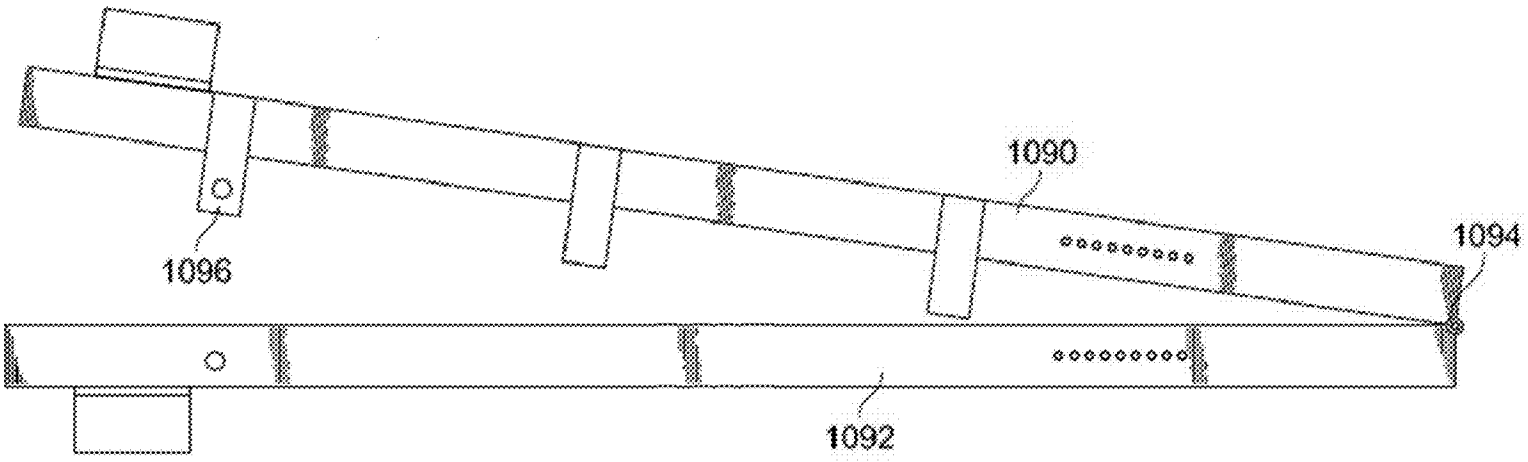
FIG. 11 illustrates a view of one of the side plates of the housing of a nonlimiting example of a master air jet of the present invention for use in conjunction with the systems of the present invention.

Referring now to FIGS. 10-11, nonlimiting examples of a master air jet of the present invention and components thereof, master air jet 1040 may have a pair of hinged side plates having side plate top half 1090 and side plate bottom half 1092, and side plate hinge 1094. Housing 1042 may be generally formed by top plate 1080 operably attached to side plate top half 1090 and bottom plate 1082 operably attached to side plate bottom half 1092. It should be noted that side, top, and bottom to modify the plates (or components thereof) are used for simplicity in describing the master air jet and should not be taken to be limiting as to the relation of the master air jet to the plane of the ground.

The side plates may have side plate guides 1096 operably attached to either side plate top half 1090 and side plate bottom half 1092 (not shown) to ensure proper alignment when the side plates are closed. To keep the side plate halves 1090 and 1092 closed during operation, at least one side plate guide 1096 may be capable of operably attaching to both side plate halves 1090 and 1092. As shown in FIGS. 10-11, one side plate guide 1096 is attached to side plate top half 1090 and has a hole that lines up with a threaded hole in side plate bottom half 1092 allowing for a bolt to secure side plate halves 1090 and 1092 in the closed position.

One skilled in the art should recognize the plurality of modification to hinged side plates that achieve the same function of the master air jet, e.g., side plate halves with grooves rather than side plate guides to ensure proper alignment. Further, one skilled in the art should recognize that during operation a processed tow band passing through the master air jet may snag on some imperfections (e.g., burs or gaps) in the side plates, especially at high air jet speeds. Snagging has the potential to adversely affect the edges of the bulked webs produced and, in some cases, cause inoperability of the master air jet.

Figure 12:
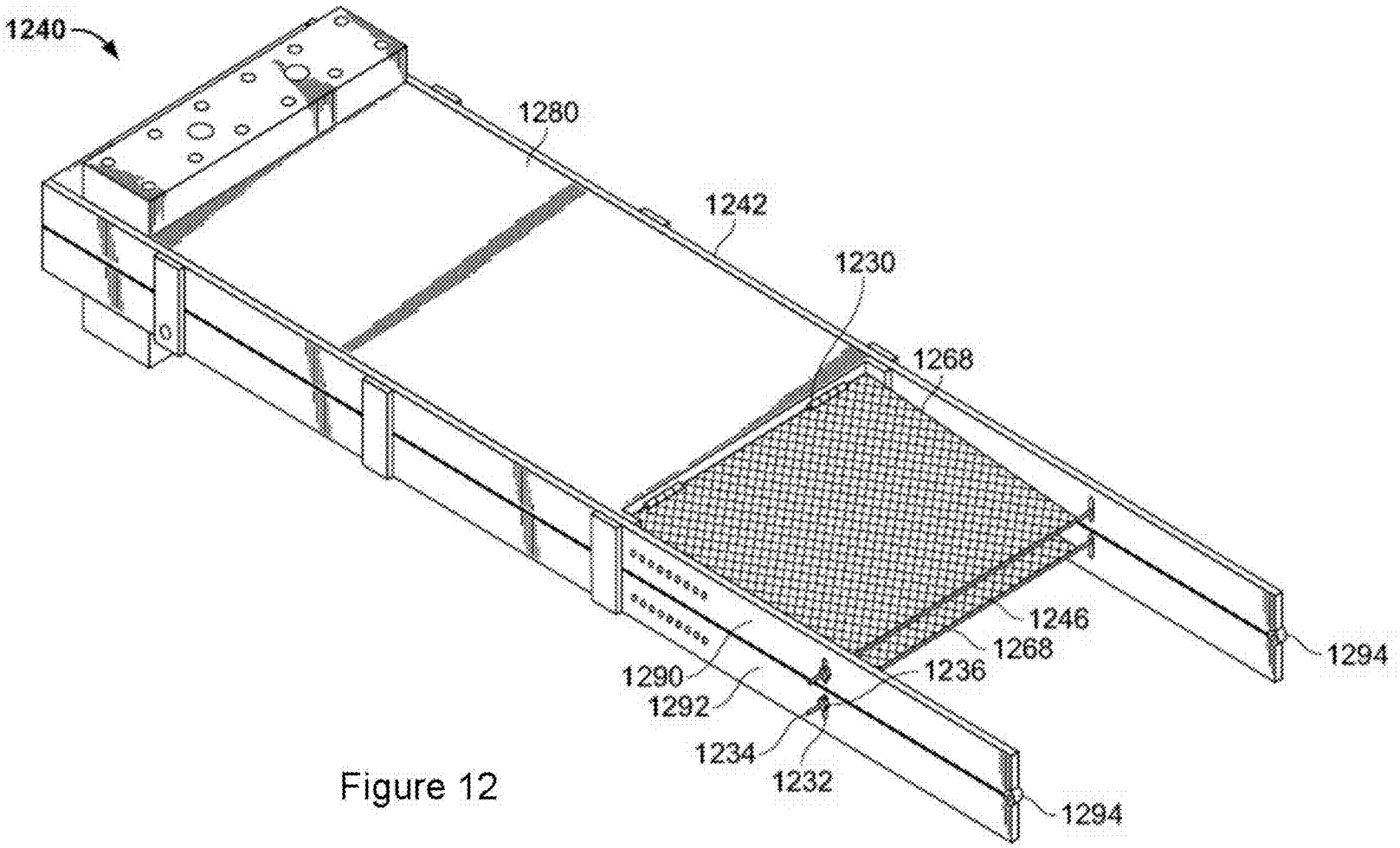
FIG. 12 illustrates a perspective view of a nonlimiting example of a master air jet of the present invention for use in conjunction with the systems of the present invention.

In some embodiments, master air jets of the present invention may have a sizeable outlet opening. Referring now to FIG. 12, a nonlimiting example of a master air jet of the present invention and components thereof, master air jet 1240 may include housing 1242 that generally is formed by a pair of side plates having side plate top half 1290 and side plate bottom half 1292 with side plate hinge 1294; top plate 1280 operably attached to side plate top half 1290, and bottom plate 1282 (not shown) operably attached to side plate bottom half 1292. Accumulating chamber 1262 (not shown) is formed by a pair of perforated plates 1268 fixed in place to top plate 1280 and bottom plate 1282 by hinges 1230 that allow for sizing outlet 1246 by fixing perforated plates 1268 into position by securing perforated plate sizing rods 1234 in outlet sizing guides 1232 with nut 1236.

One skilled in the art should recognize the plurality of modification to hinged perforated plates that achieve the same function of the master air jet, e.g., vertical screws to adjust the location of the perforated plates and consequently the size of the outlet opening on the fly. One skilled in the art should recognize the modifications should maintain the intended purpose of the perforated plates, i.e., provide a brake for the processed tow bands passing therethrough so as to create the bulk of the subsequent bulked web.

In some embodiments, master air jets of the present invention may have any combination of the features including, but not limited to, adjustable side plates, hinged side plates, a sizeable inlet opening, and a sizeable outlet opening. In some embodiments, the present invention provides a master air jet that comprises an inlet opening to a central passageway, the inlet opening having a width of about 5 cm to about 10 m and a height of about 0.5 cm to about 5 cm; an air jet capable of forming a Venturi in a central passageway; a forming chamber along the central passageway disposed after the air jet; an accumulation chamber formed by at least two perforated plates and at least two side plates, the accumulation chamber being disposed along the central passageway after the forming chamber; and an outlet opening to the central passageway, the outlet opening having a width of about 5 cm to about 10 m and a height of about 2 mm to about 500 mm. In some embodiments said master air jet may have a sizeable inlet opening and/or a sizeable outlet opening.

In some embodiments, master air jets of the present invention may be configured with an inlet opening having dimensions of width ranging from a lower limit of about 5 cm, 10 cm, 25 cm, or 50 cm to an upper limit of about 10 m, 5 m, 1 m (100 cm), or 50 cm, and wherein the inlet opening width may range from any lower limit to any upper limit and encompass any subset therebetween. In some embodiments, master air jets of the present invention may be configured with an inlet opening having dimensions of height ranging from a lower limit of about 0.5 cm, 1 cm, 2 cm, or 3 cm to and upper limit of about 5 cm, 4 cm, or 3 cm, and wherein the inlet opening height may range from any lower limit to any upper limit and encompass any subset therebetween.

In some embodiments, master air jets of the present invention may be configured with an outlet opening having dimensions of width ranging from a lower limit of about 5 cm, 10 cm, 25 cm, or 50 cm to an upper limit of about 10 m, 5 m, 1 m (100 cm), or 50 cm, and wherein the outlet opening width may range from any lower limit to any upper limit and encompass any subset therebetween. In some embodiments, master air jets of the present invention may be configured with an outlet opening having dimensions of height ranging from a lower limit of about 2 mm, 3 mm, 5 mm, 10 mm, 15 mm, 25 mm, or 50 mm to an upper limit of about 500 mm, 250 mm, 200 mm, 150 mm, 100 mm, or 50 mm, and wherein the outlet opening height may range from any lower limit to any upper limit and encompass any subset therebetween.

In some embodiments of the present invention, two or more master air jets may be in series. Because master air jets produce bulked webs with increased caliper, the dimensions of the inlet of the second (or greater) master air jet in a series should be appropriately sized. It should be noted that the Venturi in the master air jet may create some tension on the processed tow bands (or bulked webs for embodiments with master air jets in series). As such, the caliper of the processed tow bands (or bulked webs) may be less entering the master air jet than the caliper of the processed tow bands (or bulked webs) leaving the tow band processing lines (or a previous master air jet). Further, to control the proper transfer from one master air jet to another, one skilled in the art should recognize the potential apparatuses and/or machinery that may assist with ensuring the second (or greater) master air jet does not create too much tension on the bulked web so as to hinder the proper operation of the previous master air jet. By way of a nonlimiting example, tension rollers may be used for proper transfer between master air jets.

Some embodiments may involve producing bulked webs from continuous tow bands. In some embodiments, producing bulked webs from continuous tow bands may comprise processing at least one continuous tow band to form processed tow bands and forming a bulked web from the processed tow band(s). In some embodiments, producing bulked webs from continuous tow bands may comprise processing a plurality of tow bands to form processed tow bands and combining the processed tow bands into a bulked web. As used herein, the term "continuous tow band" refers to a collection of continuous (e.g., indefinite or extreme length) fiber filaments without defined twist usually held together with a crimp and/or tackifier. As used herein, the term "bulking," and derivatives thereof, refers to increasing caliper without substantial spreading laterally. As used herein, the term "caliper" refers to thickness. As used herein, the term "processed tow bands," and derivatives thereof, refers to a tow band that has been processed along a tow band processing line. As used herein, the term "bulked web" refers to the product of entangled filaments from the master air jet.

In some embodiments, processing continuous tow bands may occur along tow band processing lines. In some embodiments, tow band processing lines may include apparatuses and/or machinery to spread tow bands, uncrimp tow bands, open tow bands, bulk tow bands, apply additives to tow bands, or any combination thereof. One skilled in the art should understand the apparatuses and/or machinery needed to spread tow bands, uncrimp tow bands, bulk tow bands, apply additives to tow bands, or any combination thereof. Nonlimiting examples of suitable apparatuses and/or machinery may include spreaders, tension rollers, guide rollers, air bulking jets, sprayers, steamers, and the like, or any combination thereof. Examples of air bulking jets are described in more detail herein and can be found in U.S. Pat. Nos. 6,253,431 and 6,543,106, the entire disclosures of which are incorporated herein by reference.

In some embodiments, systems of the present invention may include multiple (at least two) tow band processing lines. In some embodiments, systems may include a number of tow band processing lines ranging from a lower limit of about 2, 3, 5, or 10 to an upper limit of about 100, 50, 40, 30, or 20, and wherein the number of tow band processing lines may range from any lower limit to any upper limit and encompass any subset therebetween.

In some embodiments, a tow band processing line may process one or more continuous tow bands. By way of nonlimiting example, in some embodiments of the present invention, as illustrated in FIG. 1A, one continuous tow band may be processed along a tow band processing line including at least spreaders and tension rollers. The processed tow band from the processing line may be received by a master air jet and formed into a bulked web. By way of nonlimiting example, in some embodiments of the present invention, as illustrated in FIG. 1B, some embodiments may involve processing four continuous tow bands along two tow band processing lines (two continuous tow bands per processing line) each including at least spreaders and tension rollers. The processed tow bands produced therefrom may be received by a master air jet in a stacked configuration to produce a bulked web having a cross-sectional make-up substantially similar to the composition and relative orientation of the process tow band as introduced into the master air jet. By way of another nonlimiting example of the present invention, as illustrated in FIG. 1C, some embodiments may involve processing eight continuous tow bands along three tow band processing lines (three continuous tow bands along two tow processing lines and two continuous tow bands along a third tow band processing line). Two of the tow band processing lines may include spreaders and tension rollers, while the third tow band processing line may include spreaders, tension rollers, and an air forming jet. The processed tow bands produced therefrom may be received by a master air jet in a stacked configuration to produce a bulked web having a cross-sectional make-up substantially similar to the composition and relative orientation of the process tow band as introduced into the master air jet.

It should be noted that in FIGS. 1B and 1C processed tow bands from multiple continuous tow bands are depicted as a single processed tow band. However, in some embodiments, processing a plurality of continuous tow bands along a single tow band processing line may yield a single processed tow band comprising the plurality of continuous tow bands having been processed or a plurality of processed tow bands comprising one or some subset of the continuous tow bands having been processed. By way of nonlimiting example, a system of the present invention may comprise a tow band processing line capable of receiving at least two continuous tow bands and producing a single processed tow band. By way of another nonlimiting example, a system of the present invention may comprise a tow band processing line capable of receiving at least two continuous tow bands and producing the same number of processed tow bands. By way of yet another nonlimiting example, a system of the present invention may comprise a tow band processing line capable of receiving at least three continuous tow bands and producing two processed tow bands.

In some embodiments of the present invention, a continuous tow band may comprise more than one type of filament as characterized by, inter alia, composition, cross-sectional shape, denier per filament, any other suitable characteristic, or any combination thereof. In some embodiments, tow band processing lines for use in conjunction with the present invention may process more than one of the same type of tow bands. In some embodiments, tow band processing lines for use in conjunction with the present invention may process more than one tow band as characterized by, inter alia, filament composition, filament cross-sectional shape, denier per filament, total denier, any other suitable characteristic, or any combination thereof.

Figure 2:
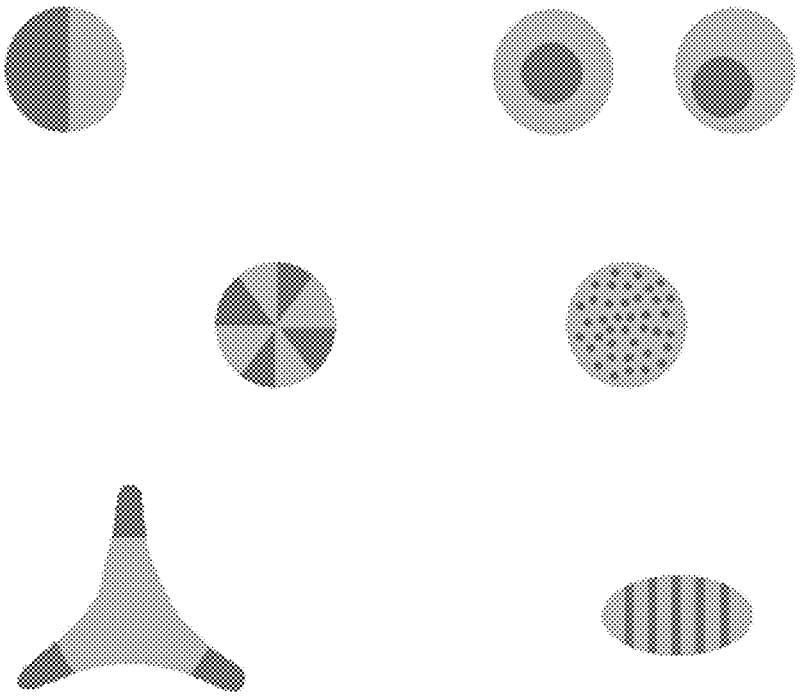
FIG. 2 illustrates nonlimiting examples of cross-sectional shapes and compositions of bicomponent fibers.

Examples of suitable continuous tow bands for use in conjunction with the present invention may include, but not be limited to, continuous tow bands that include carbon filaments, activated carbon filaments, natural fibers, synthetic filaments, bicomponent fibers, or any combination thereof. Suitable continuous tow bands for use in conjunction with the present invention may also comprise filaments that comprise polyolefins, polyethylenes, polypropylenes, polyesters, polyethylene terphalate, lyocells (e.g., TENCEL®, a lyocell, available from The Lenzing Group), viscoses, rayons, polyamines, polyamides, polypropylene oxides, polyethylene sulfides, polyphenylene sulfide, liquid crystalline polymeric substances capable of being formed into fibers, silks, wools, cottons, rayons, polyacrylates, polymethacrylates, cellulose acetates, cellulose diacetates, cellulose triacetates, cellulose propionates, cellulose butyrates, cellulose acetate-propionates, cellulose acetate-butyrates, cellulose propionate-butyrates, starch acetates, acrylonitriles, vinyl chlorides, vinyl esters, vinyl ethers, and the like, any derivative thereof, any blend polymer thereof, any copolymer thereof, or any combination thereof. Suitable configurations for bicomponent fibers for use in conjunction with the present invention may include, but not be limited to, side-by-side, sheath-core, segmented-pie, islands-in-the-sea, tipped, segmented-ribbon, or any hybrid thereof, nonlimiting examples of which are illustrated in FIG. 2.

In some embodiments, the continuous tow bands, or at least some filaments thereof, may comprise additives. Suitable additives are detailed further herein.

The filaments may have any suitable cross-sectional shape, including, but not limited to, circular, substantially circular, crenulated, ovular, substantially ovular, polygonal, substantially polygonal, dog-bone, "Y," "X," "K," "C," multi-lobe, and any hybrid thereof. As used herein, the term "multi-lobe" refers to a cross-sectional shape having a point (not necessarily in the center of the cross-section) from which at least two lobes extend (not necessarily evenly spaced or evenly sized).

It should be noted that when "about" is provided below in reference to a number in a numerical list, the term "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

In some embodiments, continuous tow bands for use in conjunction with the present invention may have a denier per filament (dpf) ranging from a lower limit of about 1, 2, 3, 5, 10, 12, 15, or 16 to an upper limit of about 50, 40, 30, 20, 15, 12, 10, 7, or 5, and wherein the denier per filament may range from any lower limit to any upper limit and encompass any subset therebetween. In some embodiments, continuous tow bands may have a denier per filament of about 50 or less, and most preferably 10 or less.

In some embodiments, continuous tow bands for use in conjunction with the present invention may have a total denier ranging from a lower limit of about 10,000, 30,000, 50,000, 100,000, 250,000, or 500,000 to an upper limit of about 100,000, 250,000, 500,000, 1,000,000, 2,000,000, or 3,000,000, and wherein the total denier may range from any lower limit to any upper limit and encompass any subset therebetween. In some embodiments, continuous tow bands for use in conjunction with the present invention may have a total denier of about 100,000 or greater. By way of nonlimiting example, a continuous tow band for use in conjunction with the present invention may comprise cellulose acetate filaments and have a total denier of 280,000 or less and a dpf of about 10 or less.

In some embodiments, continuous tow bands and/or processed tow bands (i.e., tow bands having been processed along the tow band processing line) for use in conjunction with the present invention may have a width of about 60 cm or less. In some embodiments, continuous tow bands and/or processed tow bands for use in conjunction with the present invention may have a width ranging from a lower limit of about 1, 2, 4, or 3 cm to an upper limit of about 75, 50, 25, or 10 cm, and wherein the width may range from any lower limit to any upper limit and encompass any subset therebetween.

In some embodiments of the present invention, processed tow bands may have a caliper of about 2 mm or greater. In some embodiments of the present invention, processed tow bands may have a caliper ranging from a lower limit of about 2 mm, 3 mm, 5 mm, or 10 mm to an upper limit of about 100 mm, 50 mm, 25 mm, or 10 mm, and wherein the caliper of the processed tow bands may range from any lower limit to any upper limit and encompass any subset therebetween.

Some embodiments of the present invention may involve combining processed tow bands using a master air jet. Said processed tow bands may be the same or different. In some embodiments of the present invention, the plurality of tow band processing lines may produce the same processed tow bands. In some embodiments of the present invention, the plurality of tow band processing lines may produce more than one type of processed tow band as characterized by, inter alia, composition, cross-sectional shape of the filaments, dpf of the filaments, total denier of the continuous tow bands, caliper of the processed tow bands, bulk density of the processed tow bands, any other suitable characteristic, or any combination thereof.

In some embodiments of the present invention, the master air jet may be configured to receive the processed tow bands side-by-side with minimal to no overlap, stacked with substantial overlap, or any combination thereof. In some embodiments, the master air jet may be configured to receive a plurality of processed tow bands to produce a bulked web with a cross-sectional make-up that substantially resembles the compositional and positional relationship of the plurality of processed tow bands introduced into the master air jet. It should be noted that in some embodiments in passing through the master air jet of the present invention, the processed tow band compositions are expected to entangle at their interfaces, and therefore the bulked web will have a larger degree of entanglement and a cross-sectional make-up substantially resembling the compositional and positional relationship of the processed tow bands as introduced. The degree to which the cross-sectional make-up of the bulked web resembles the compositional and positional relationship of the tow bands as introduced will depend on, inter alia, the configuration and processing parameters of the master air jet and the size and shape of the processed tow bands introduced, e.g., higher caliper processed tow bands introduced in a stacked configuration will yield a bulked web with better defined layers than would lower caliper processed tow bands.

Figure 3:
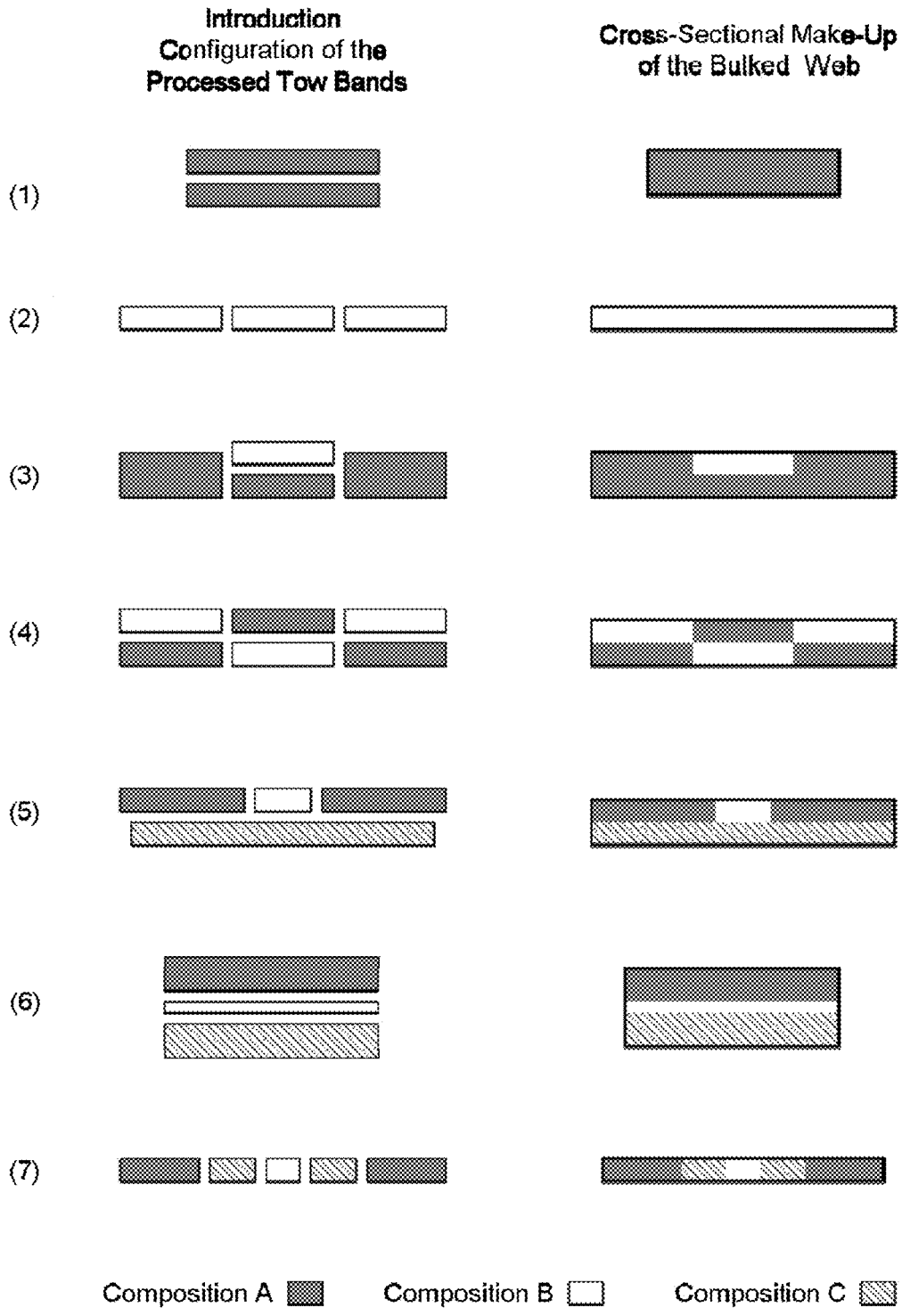
FIG. 3 illustrates nonlimiting examples of the composition of bulked webs that can be achieved from processed tow band configurations using systems according to the present invention.
Figure 4:
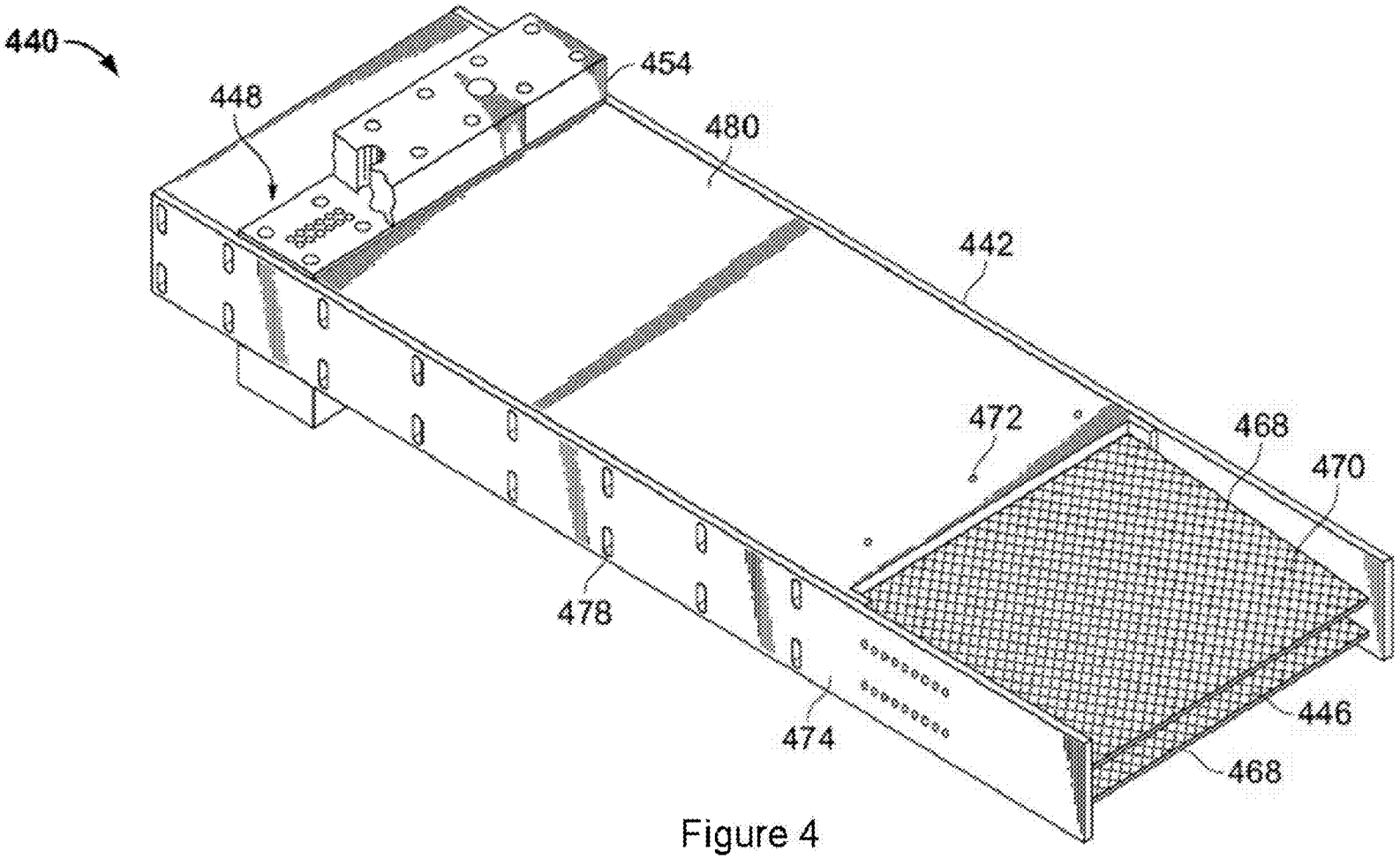
FIG. 4 illustrates a perspective view of a nonlimiting example of a master air jet of the present invention for use in conjunction with the systems of the present invention.

Bulked webs of the present invention may, in some embodiments, have a variety of cross-sectional make-ups based on the configuration in which processed tow bands are introduced into master air jet. FIG. 3 illustrates a variety of bulked web cross-sectional make-ups with possible corresponding processed tow band introduction configurations. From top to bottom, FIG. 3 illustrates (1) two equally sized processed tow bands of composition A in a stacked configuration yielding a bulked web approximately of composition A twice the caliper and substantially the same width; (2) three equally sized processed tow bands of composition B in a side-by-side configuration yielding a bulked web of composition B substantially the same caliper and approximately three times the width of an individual processed tow band; (3) two equally sized processed tow bands of composition A and composition B in a stacked configuration that are in a side-by-side configuration between two processed tow bands of composition A of approximately twice the caliper as the internal tow bands yielding a bulked web approximately substantially the same caliper as the outer tow bands having a center stripe on one side of composition A with the remainder being composition B; (4) six equally sized processed tow bands configured in two rows of three, the top row being compositions B-A-B and the bottom row being A-B-A yielding a bulked web with a checkerboard cross-sectional make-up, a caliper approximately twice that of a single bulked to band from which it was produced, and a width approximately three times that of a single bulked to band from which it was produced; (5) four processed tow bands in a two row configuration with the top row being three tow bands having substantially the same caliper of compositions A-B-A in a side-by-side configuration where the processed tow bands of composition A are just over twice the width of the processed tow band of composition B and with the bottom row being a single processed tow band of composition C having a caliper approximately that of the top row tow bands and a width approximately that of the total width of the top row yielding a bulked web having one side of a single composition (composition C) and the other side being composition A with a small width strip of composition B down the center; (6) three processed tow bands having substantially the same width in a stacked configuration of compositions A-B-C where processed tow bands of composition A and C are substantially the same caliper with approximately three times the caliper of processed tow band of composition B yielding a bulked web having a sandwiched configuration with one side being composition A, the other side being composition C, and the middle being a thin (small caliper) of composition B; and (7) five processed tow bands of substantially the same caliper in a side-by-side configuration of compositions A-C-B-C-A where processed tow bands of composition C are slightly wider (approximately 1.3 times) than the processed tow band of composition B and processed tow bands of composition A are approximately twice the width of the processed tow band of composition B yielding a bulked web of approximately the same caliper as the individual processed tow bands having a stripped composition A-C-B-C-A with the stripes being approximately the width of the corresponding processed tow bands. It should be noted, that while FIG. 3 may show clear demarcations in the bulked webs between different compositions, one skilled in the art, with the benefit of this disclosure, should understand that the interface between compositions will be a mixture of the compositions. The degree of mixing at the interface may depend, inter alia, on the setting of the master air jet (e.g., air flow and plate separation), speed at which the processed tow bands are processed through the master air jet, and the caliper and composition of the processed tow bands.

In some embodiments, bulked webs of the present invention may have a caliper ranging from about the height of to about 20% greater than the height of the outlet of the master air jet. In some embodiments, bulked webs of the present invention may have a caliper of about 10 mm or greater. In some embodiments, bulked webs of the present invention may have a caliper ranging from a lower limit of about 2 mm, 3 mm, 5 mm, 10 mm, 15 mm, 25 mm, or 50 mm to an upper limit of about 500 mm, 250 mm, 200 mm, 150 mm, 100 mm, or 50 mm, and wherein the caliper of processed tow bands may range from any lower limit to any upper limit and encompass any subset therebetween.

In some embodiments, bulked webs of the present invention may have a bulk density of about 0.05 g/cm$^3$ or less. In some embodiments, bulked webs of the present invention may have a bulk density ranging from a lower limit of about 0.005 g/cm$^3$ or 0.01 g/cm$^3$ to an upper limit of about 0.1 g/cm$^3$, 0.05 g/cm$^3$, or 0.01 g/cm$^3$, and wherein the bulk density of bulked webs may range from any lower limit to any upper limit and encompass any subset therebetween.

In some embodiments, bulked webs of the present invention may have a width substantially the same as the width of the widest processed tow band(s) from which it is formed. In some embodiments, bulked webs of the present invention may have a width substantially the same as the sum of the width of processed tow bands from which it is formed. In some embodiments, bulked webs of the present invention may have a width ranging from a lower limit of about 5 cm, 10 cm, 25 cm, or 50 cm to an upper limit of about 10 m, 5 m, 1 m (100 cm), or 50 cm, and wherein the width may range from any lower limit to any upper limit and encompass any subset therebetween. In some embodiments, bulked webs of the present invention may have a width of about 15 cm or greater. In some embodiments, bulked webs of the present invention may have a width of about 30 cm or greater. In some embodiments, bulked webs of the present invention may have a width of about 50 cm or greater. In some embodiments, bulked webs of the present invention may have a width of about 1 m or greater. By way of nonlimiting example, a polyester tow having 300,000 total denier and an initial width of about 10 cm may be run through a tow band processing line having three spreaders and a delivery roll and then introduced to a master air jet at width of about 25 cm to produce a bulked web having a caliper of about 4 cm and a width of about 25 cm.

Some embodiments of the present invention may involve applying additives to the bulked webs. Suitable additives and methods of application are detailed further herein. By way of nonlimiting example, additives, such as tackifiers and/or plasticizers, may be applied to a bulked web to provide additional filament to filament adhesion/bonding, which may provide additional strength in a final nonwoven material.

Some embodiments of the present invention may involve passing heated gases through the master air jet during formation of the bulked web. Some embodiments of the present invention may involve passing inert gases through the master air jet, which may advantageously reduce oxidation of the filament surfaces, especially if the gas is heated. Some embodiments of the present invention may involve passing a heated gas comprising a liquid (e.g., steam) through the master air jet.

Some embodiments of the present invention may involve heating the bulked webs. By way of nonlimiting example, heat setting may be conducted on a bulked web to provide additional filament to filament adhesion/bonding, which may provide additional strength in a final nonwoven material.

Some embodiments of the present invention may involve collecting the bulked webs for storage and/or transporting (e.g., shipping). In some embodiments, systems for producing bulked webs of the present invention from tow bands may comprise a plurality of tow band processing lines, a master air jet, and a collection area.

Some embodiments may involve transporting the bulked webs for further processing. Some embodiments may involve transporting a bulked web to a nonwoven manufacturing line. Some embodiments may involve producing a nonwoven material from a bulked web. In some embodiments of the present invention, systems for producing nonwoven materials of the present invention from continuous tow bands may comprise a plurality of tow band processing lines, a master air jet, and a nonwoven manufacturing line.

In some embodiments, bulked webs of the present invention may be the nonwoven materials with no further processing. In some embodiments of the present invention, systems for producing nonwoven materials of the present invention from continuous tow bands may comprise a plurality of tow band processing lines and a master air jet.

In some embodiments of the present invention, nonwoven materials of the present invention made from continuous tow bands may have a caliper of about 0.5 mm or greater. In some embodiments, nonwoven materials of the present invention made from continuous tow bands may have a caliper ranging from a lower limit of about 0.5 mm, 1 mm, 2 mm, 3 mm, 5 mm, 10 mm, 15 mm, 25 mm, or 50 mm to an upper limit of about 250 mm, 200 mm, 150 mm, 100 mm, or 50 mm, and wherein the caliper of nonwoven materials may range from any lower limit to any upper limit and encompass any subset therebetween.

In some embodiments, nonwoven materials of the present invention made from continuous tow bands may have a bulk density of about 0.25 g/cm$^3$ or less. In some embodiments, nonwoven materials of the present invention made from continuous tow bands may have a bulk density ranging from a lower limit of about 0.005 g/cm$^3$, 0.01 g/cm$^3$, or 0.05 g/cm$^3$ to an upper limit of about 0.5 g/cm$^3$, 0.25 g/cm$^3$, 0.2 g/cm$^3$, or 0.1 g/cm$^3$, and wherein the bulk density of nonwoven materials may range from any lower limit to any upper limit and encompass any subset therebetween.

In some embodiments, nonwoven materials of the present invention made from bulked webs of the present invention may have a width substantially the same as the bulked webs from which it is produced. In some embodiments, nonwoven materials of the present invention made from continuous tow bands may have a width ranging from a lower limit of about 5 cm, 10 cm, 25 cm, or 50 cm to an upper limit of about 10 m, 5 m, 1 m (100 cm), or 50 cm, and wherein the width may range from any lower limit to any upper limit and encompass any subset therebetween. In some embodiments, nonwoven materials of the present invention made from continuous tow bands may have a width of about 15 cm or greater. In some embodiments, nonwoven materials of the present invention made from continuous tow bands may have a width of about 30 cm or greater. In some embodiments, nonwoven materials of the present invention made from continuous tow bands may have a width of about 50 cm or greater. In some embodiments, nonwoven materials of the present invention made from continuous tow bands may have a width of about 1 m or greater.

In some embodiments, nonwoven manufacturing lines that may be used in conjunction with the systems and methods of the present invention may generally include any processing areas and processing apparatuses in any configuration known to one skilled in the art. Suitable processing areas may include, but not be limited to, additive application areas, calendaring areas, hydroentanglement areas, needlelooming areas, needlepunching areas, resin-bonding areas, thermal bonding areas, through air bonding areas, crosslapping areas, drying areas, heating areas, cooling areas, collection areas, any hybrid thereof, or any combination thereof. Suitable processing apparatuses may include, but not be limited to, additive application apparatuses, calendaring apparatuses, hydroentanglement apparatuses, needlelooming apparatuses, needlepunching apparatuses, resin-bond apparatuses, thermal bonding apparatuses, through air bonding apparatuses, crosslapping apparatuses, drying apparatuses, thermal elements, collection apparatuses, any hybrid thereof, or any combination thereof. It should be noted that crosslapping may occur in any configuration using at least one selected from the group of bulked webs described herein, nonwoven materials described herein from continuous tow bands, webs and/or nonwoven materials produced from carding lines, or any combination thereof. By way of nonlimiting example, a bulked web of greater than about 100 mm in width may be crosslapped with webs produced from carding staple fibers in the production of a nonwoven material according the present invention. By way of another nonlimiting example, a nonwoven material produced from carding staple fibers may be crosslapped with nonwoven materials produced from tow bands as described herein in the production of a nonwoven material according the present invention.

The ability to crosslap the bulked webs and/or nonwoven materials from tow bands as described herein with webs and/or nonwoven materials from carding processes may advantageously produce final nonwoven materials with new compositions not previously achievable. By way of nonlimiting example, a carded web of polyester may be crosslapped with a bulked web from cellulose acetate tow bands as described herein.

Nonwoven materials of the present invention made from continuous tow bands may be manufactured, in some embodiments, to have a variety of characteristics including, but not limited to, colors, printable surfaces, high to low density, high to low absorbency of water or oil, high to low water-permeable, high to low air-permeable, high to low UV-permeability, rotting resistance, anti-bacterial surfaces, non-stick, corrosion resistance, abrasion resistance, abrasion enhancement, higher mechanical strength, textures, durability, lauderability, deformability (stretchability), electrostatic dissipation, fire retardation, and/or light diffusion. One skilled in the art should understand the necessary manufacturing requirements including the composition of the continuous tow bands from which the nonwoven material is produced, the inclusion of additives including when and how to apply the additives, and the manufacturing processes used to produce the nonwoven material.

Some embodiments of the present invention may involve producing products from nonwoven materials produced from continuous tow bands according to any embodiment disclosed herein. In some embodiments of the present invention, systems may include product production lines capable of converting nonwoven materials into products. Nonlimiting examples of products may include hygiene products (e.g., baby diapers, incontinence products, feminine hygiene products), disposable medical products (e.g., gauze, bandages, band-aids, wound pads, orthopedic waddings, stoma products, adhesive plasters, compresses, tapes, wraps, masks, gowns, and shoe covers), insulation products (e.g., for thermal, acoustic, and/or vibration insulation) (e.g., clothing, packs, vehicles, textiles, and noise damping in ceilings and walls), furniture textiles (e.g., upholstery, bedware, and quilted products), sorbents (e.g., for automotive, chemical, emergency responders, or packaging) (e.g., rags, pads, wraps, medical supplies, and oil booms), horticulture products (e.g., covering to protect plants from extreme temperatures at night or day), tapes for use with cables (e.g., for water-blocking, electrically conductivity, or thermal barriers), composite materials (e.g., glass-fiber-reinforced plastics), surfacing products (e.g., pipes, tanks, container boards, façade panels, skis, surfboards, and boats), window treatments, shoe inserts (e.g., liners, counterliners, interliners, and reinforcing materials), the inside layer of tufted carpets and carpet tiles, carpet backings, fluid filters (e.g., configured as cartridges, cassettes, bags, sheets, mats, screens, and films) (e.g., milk filters, coolant filters, metal-processing filters, blood plasma filters, frying fat filters, drinking water filters, enzyme filters, vacuum filters, kitchen hood filters, respirator filters, appliance filters, furnace filters, high-temperature filters, activated carbon filters, and pocket filters), low density abrasives (e.g., hand pads, wipes, sponge laminates, floor pads, brushes, wools, wheels, and belts), polishing pads (e.g., for use in manufacturing semiconductor wafers, memory discs, precision optics, and metallurgical components), vehicle interiors (e.g., headliners, trunkliners, door trim, package trays, sunvisors, and seats), containers (e.g., bags), and the like.

Some embodiments of the present invention may involve applying additives to the continuous tow bands, processed tow bands, bulked webs, or nonwoven materials, products therefrom, or any combination thereof. Suitable additives for use in conjunction with the present invention are detailed further herein. In some embodiments of the present invention, systems for producing bulked webs from continuous tow bands may include at least one additive application area. Additive application areas may be disposed along at least one tow band processing line, before at least one air bulking jet, between at least one tow band processing line and the master air jet, between at least one air bulking jet and the master air jet, after the master air jet, between the master air jet and the nonwoven manufacturing line, along the nonwoven manufacturing line, between the nonwoven manufacturing line and the product production line, and/or along the product production line. It should be noted that applying includes, but is not limited to, dipping, immersing, submerging, soaking, rinsing, washing, painting, coating, showering, drizzling, spraying, placing, dusting, sprinkling, affixing, and any combination thereof. Further, it should be noted that applying includes, but is not limited to, surface treatments, infusion treatments where the additive incorporates at least partially into filaments, and any combination thereof.

Suitable additives for use in conjunction with the present invention may include, but not be limited to, active particles, active compounds, ion exchange resins, superabsorbent polymers, zeolites, nanoparticles, ceramic particles, abrasive particulates, absorbent particulates, softening agents, plasticizers, pigments, dyes, flavorants, aromas, controlled release vesicles, binders, adhesives, tackifiers, surface modification agents, lubricating agents, emulsifiers, vitamins, peroxides, biocides, antifungals, antimicrobials, deodorizers, antistatic agents, flame retardants, antifoaming agents, degradation agents, conductivity modifying agents, stabilizing agents, or any combination thereof. Said additives are detailed further herein.

Active particles for use in conjunction with the present invention may be useful in actively reducing components from a fluid stream by absorption or reaction. Suitable active particles for use in conjunction with the present invention may include, but not be limited to, nano-scaled carbon particles, carbon nanotubes having at least one wall, carbon nanohorns, bamboo-like carbon nanostructures, fullerenes, fullerene aggregates, graphene, few layer graphene, oxidized graphene, iron oxide nanoparticles, nanoparticles, metal nanoparticles, gold nanoparticles, silver nanoparticles, metal oxide nanoparticles, alumina nanoparticles, magnetic nanoparticles, paramagnetic nanoparticles, superparamagnetic nanoparticles, gadolinium oxide nanoparticles, hematite nanoparticles, magnetite nanoparticles, gado-nanotubes, endofullerenes, $Gd@C_{60}$, core-shell nanoparticles, onionated nanoparticles, nanoshells, onionated iron oxide nanoparticles, activated carbon, ion exchange resins, desiccants, silicates, molecular sieves, silica gels, activated alumina, zeolites, perlite, sepiolite, Fuller's Earth, magnesium silicate, metal oxides, iron oxides, activated carbon, and any combination thereof.

Suitable active particles for use in conjunction with the present invention may have at least one dimension of about less than one nanometer, such as graphene, to as large as a particle having a diameter of about 5000 nanometers. Active particles for use in conjunction with the present invention may range from a lower size limit in at least one dimension of about: 0.1 nanometers, 0.5 nanometers, 1 nanometer, 10 nanometers, 100 nanometers, 500 nanometers, 1 micron, 5 microns, 10 microns, 50 microns, 100 microns, 150 microns, 200 microns, and 250 microns. The active particles may range from an upper size limit in at least one dimension of about: 5000 microns, 2000 microns, 1000 microns, 900 microns, 700 microns, 500 microns, 400 microns, 300 microns, 250 microns, 200 microns, 150 microns, 100 microns, 50 microns, 10 microns, and 500 nanometers. Any combination of lower limits and upper limits above may be suitable for use in conjunction with the present invention, wherein the selected maximum size is greater than the selected minimum size. In some embodiments, the active particles for use in conjunction with the present invention may be a mixture of particle sizes ranging from the above lower and upper limits. In some embodiments of the present invention, the size of the active particles may be polymodal.

Active compounds for use in conjunction with the present invention may be useful in actively reducing components from a fluid stream by absorption or reaction. Suitable active compounds for use in conjunction with the present invention may include, but not be limited to, malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, or any combination thereof.

Suitable ion exchange resins for use in conjunction with the present invention may include, but not be limited to, polymers with a backbone, such as styrene-divinyl benezene (DVB) copolymer, acrylates, methacrylates, phenol formaldehyde condensates, and epichlorohydrin amine condensates; a plurality of electrically charged functional groups attached to the polymer backbone; or any combination thereof.

As used herein, the term "superabsorbent materials" refers to materials, e.g., polymers, capable of absorbing at least three times their weight of a fluid. Suitable superabsorbent materials for use in conjunction with the present invention may include, but not be limited to, sodium polyacrylate, starch graved copolymers of polyacrylonitriles, polyvinyl alcohol copolymers, cross-linked poly(ethylene oxides), polyacrylamide copolymers, ethylene maleic anhydride copolymers, cross-linked carboxymethylcelluloses, and the like, or any combination thereof. By way of nonlimiting example, superabsorbent materials incorporated into a non-woven may be useful in chemical spill rags and kits.

Zeolites for use in conjunction with the present invention may include crystalline aluminosilicates having pores, e.g., channels, or cavities of uniform, molecular-sized dimensions. Zeolites may include natural and synthetic materials. Suitable zeolites may include, but not be limited to, zeolite BETA ($Na_7(Al_7Si_{57}O_{128})$ tetragonal), zeolite ZSM-5 ($Na_n(Al_nSi_{96-n}O_{192})$ 16 $H_2O$, with n<27), zeolite A, zeolite X, zeolite Y, zeolite K-G, zeolite ZK-5, zeolite ZK-4, mesoporous silicates, SBA-15, MCM-41, MCM48 modified by 3-aminopropylsilyl groups, alumino-phosphates, mesoporous aluminosilicates, other related porous materials (e.g., such as mixed oxide gels), or any combination thereof.

Suitable nanoparticles for use in conjunction with the present invention may include, but not be limited to, nano-scaled carbon particles like carbon nanotubes of any number of walls, carbon nanohorns, bamboo-like carbon nanostructures, fullerenes and fullerene aggregates, and graphene including few layer graphene and oxidized graphene; metal nanoparticles like gold and silver; metal oxide nanoparticles like alumina, silica, and titania; magnetic, paramagnetic, and superparamagentic nanoparticles like gadolinium oxide, various crystal structures of iron oxide like hematite and magnetite, about 12 nm $Fe_3O_4$, gado-nanotubes, and endofullerenes like $Gd@C_{60}$; and core-shell and onionated nanoparticles like gold and silver nanoshells, onionated iron oxide, and others nanoparticles or microparticles with an outer shell of any of said materials; and any combination of the foregoing. It should be noted that nanoparticles may include nanorods, nanospheres, nanorices, nanowires, nanostars (like nanotripods and nanotetrapods), hollow nanostructures, hybrid nanostructures that are two or more nanoparticles connected as one, and non-nano particles with nano-coatings or nano-thick walls. It should be further noted that nanoparticles for use in conjunction with the present invention may include the functionalized derivatives of nanoparticles including, but not limited to, nanoparticles that have been functionalized covalently and/or non-covalently, e.g., pi-stacking, physisorption, ionic association, van der Waals association, and the like. Suitable functional groups may include, but not be limited to, moieties comprising amines (1°, 2°, or) 3°, amides, carboxylic acids, aldehydes, ketones, ethers, esters, peroxides, silyls, organosilanes, hydrocarbons, aromatic hydrocarbons, and any combination thereof; polymers; chelating agents like ethylenediamine tetraacetate, diethylenetriamine-pentaacetic acid, triglycollamic acid, and a structure comprising a pyrrole ring; and any combination thereof.

Suitable ceramic particles for use in conjunction with the present invention may include, but not be limited to, oxides (e.g., silica, titania, alumina, beryllia, ceria, and zirconia), nonoxides (e.g., carbides, borides, nitrides, and silicides), composites thereof, or any combination thereof. Ceramic particles may be crystalline, non-crystalline, or semi-crystalline.

Suitable softening agents and/or plasticizers for use in conjunction with the present invention may include, but not be limited to, water, glycerol triacetate (triacetin), triethyl citrate, dimethoxy-ethyl phthalate, dimethyl phthalate, diethyl phthalate, methyl phthalyl ethyl glycolate, o-phenyl phenyl-(bis) phenyl phosphate, 1,4-butanediol diacetate, diacetate, dipropionate ester of triethylene glycol, dibutyrate ester of triethylene glycol, dimethoxyethyl phthalate, triethyl citrate, triacetyl glycerin, and the like, any derivative thereof, and any combination thereof. One skilled in the art with the benefit of this disclosure should understand the concentration of plasticizers to use as an additive to the filaments.

As used herein, pigments refer to compounds and/or particles that impart color and are incorporated throughout the filaments. Suitable pigments for use in conjunction with the present invention may include, but not be limited to, titanium dioxide, silicon dioxide, carbon black, tartrazine, E102, phthalocyanine blue, phthalocyanine green, quinacridones, perylene tetracarboxylic acid di-imides, dioxazines, perinones disazo pigments, anthraquinone pigments, carbon black, metal powders, iron oxide, ultramarine, calcium carbonate, kaolin clay, aluminum hydroxide, barium sulfate, zinc oxide, aluminum oxide, caramel, fruit or vegetable or spice colorants (e.g., beet powder, beta-carotene, turmeric, paprika), or any combination thereof.

As used herein, dyes refer to compounds and/or particles that impart color and are a surface treatment of the filaments. Suitable dyes for use in conjunction with the present invention may include, but not be limited to, CARTASOL® dyes (cationic dyes, available from Clariant Services) in liquid and/or granular form (e.g., CARTASOL® Brilliant Yellow K-6G liquid, CARTASOL® Yellow K-4GL liquid, CARTASOL® Yellow K-GL liquid, CARTASOL® Orange K-3GL liquid, CARTASOL® Scarlet K-2GL liquid, CARTASOL® Red K-3BN liquid, CARTASOL® Blue K-5R liquid, CARTASOL® Blue K-RL liquid, CARTASOL® Turquoise K-RL liquid/granules, CARTASOL® Brown K-BL liquid), FASTUSOL® dyes (an auxochrome, available from BASF) (e.g., Yellow 3GL, Fastusol C Blue 74L).

Suitable flavorants for use in conjunction with the present invention may include, but not be limited to, organic material (or naturally flavored particles), carriers for natural flavors, carriers for artificial flavors, and any combination thereof. Organic materials (or naturally flavored particles) include, but are not limited to, tobacco, cloves (e.g., ground cloves and clove flowers), cocoa, and the like. Natural and artificial flavors may include, but are not limited to, menthol, cloves, cherry, chocolate, orange, mint, mango, vanilla, cinnamon, tobacco, and the like. Such flavors may be provided by menthol, anethole (licorice), anisole, limonene (citrus), eugenol (clove), and the like, or any combination thereof. In some embodiments, more than one flavorant may be used including any combination of the flavorants provided herein. These flavorants may be placed in the tobacco column or in a section of a filter.

Suitable aromas for use in conjunction with the present invention may include, but not be limited to, methyl formate, methyl acetate, methyl butyrate, ethyl acetate, ethyl butyrate, isoamyl acetate, pentyl butyrate, pentyl pentanoate, octyl acetate, myrcene, geraniol, nerol, citral, citronellal, citronellol, linalool, nerolidol, limonene, camphor, terpineol, alpha-ionone, thujone, benzaldehyde, eugenol, cinnamaldehyde, ethyl maltol, vanilla, anisole, anethole, estragole, thymol, furaneol, methanol, or any combination thereof.

Suitable binders for use in conjunction with the present invention may include, but not be limited to, polyolefins, polyesters, polyamides (or nylons), polyacrylics, polystyrenes, polyvinyls, polytetrafluoroethylene (PTFE), polyether ether ketone (PEEK), any copolymer thereof, any derivative thereof, and any combination thereof. Non-fibrous plasticized cellulose derivatives may also be suitable for use as binder particles in the present invention. Examples of suitable polyolefins may include, but not be limited to, polyethylene, polypropylene, polybutylene, polymethylpentene, and the like, any copolymer thereof, any derivative thereof, and any combination thereof. Examples of suitable polyethylenes may include, but not be limited to, ultrahigh molecular weight polyethylene, very high molecular weight polyethylene, high molecular weight polyethylene, low-density polyethylene, linear low-density polyethylene, high-density polyethylene, and the like, any copolymer thereof, any derivative thereof, and any combination thereof. Examples of suitable polyesters may include, but not be limited to, polyethylene terephthalate, polybutylene terephthalate, polycyclohexylene dimethylene terephthalate, polytrimethylene terephthalate, and the like, any copolymer thereof, any derivative thereof, and any combination thereof. Examples of suitable polyacrylics may include, but not be limited to, polymethyl methacrylate, and the like, any copolymer thereof, any derivative thereof, and any combination thereof. Examples of suitable polystyrenes may include, but not be limited to, polystyrene, acrylonitrile-butadiene-styrene, styrene-acrylonitrile, styrene-butadiene, styrene-maleic anhydride, and the like, any copolymer thereof, any derivative thereof, and any combination thereof. Examples of suitable polyvinyls may include, but not be limited to, ethylene vinyl acetate, ethylene vinyl alcohol, polyvinyl chloride, and the like, any copolymer thereof, any derivative thereof, and any combination thereof. Examples of suitable cellulosics may include, but not be limited to, cellulose acetate, cellulose acetate butyrate, plasticized cellulosics, cellulose propionate, ethyl cellulose, and the like, any copolymer thereof, any derivative thereof, and any combination thereof. In some embodiments, binder particles may comprise any copolymer, any derivative, or any combination of the above listed binders. Further, binder particles may be impregnated with and/or coated with any combination of additives disclosed herein.

Suitable tackifiers for use in conjunction with the present invention may include, but not be limited to, methylcellulose, ethylcellulose, hydroxyethylcellulose, carboxy methylcellulose, carboxy ethylcellulose, water-soluble cellulose acetate, amides, diamines, polyesters, polycarbonates, silyl-modified polyamide compounds, polycarbamates, urethanes, natural resins, shellacs, acrylic acid polymers, 2-ethylhexylacrylate, acrylic acid ester polymers, acrylic acid derivative polymers, acrylic acid homopolymers, anacrylic acid ester homopolymers, poly(methyl acrylate), poly(butyl acrylate), poly(2-ethylhexyl acrylate), acrylic acid ester co-polymers, methacrylic acid derivative polymers, methacrylic acid homopolymers, methacrylic acid ester homopolymers, poly(methyl methacrylate), poly(butyl methacrylate), poly(2-ethylhexyl methacrylate), acrylamido-methyl-propane sulfonate polymers, acrylamido-methyl-propane sulfonate derivative polymers, acrylamido-methyl-propane sulfonate co-polymers, acrylic acid/acrylamido-methyl-propane sulfonate co-polymers, benzyl coco di-(hydroxyethyl) quaternary amines, p-T-amylphenols condensed with formaldehyde, dialkyl amino alkyl (meth)acrylates, acrylamides, N-(dialkyl amino alkyl) acrylamide, methacrylamides, hydroxy alkyl (meth)acrylates, methacrylic acids, acrylic acids, hydroxyethyl acrylates, and the like, any derivative thereof, or any combination thereof.

Suitable lubricating agents for use in conjunction with the present invention may include, but not be limited to, ethoxylated fatty acids (e.g., the reaction product of ethylene oxide with pelargonic acid to form poly(ethylene glycol) ("PEG") monopelargonate; the reaction product of ethylene oxide with coconut fatty acids to form PEG monolaurate), and the like, or any combination thereof. The lubricant agents may also be selected from nonwater-soluble materials such as synthetic hydrocarbon oils, alkyl esters (e.g., tridecyl stearate which is the reaction product of tridecyl alcohol and stearic acid), polyol esters (e.g., trimethylol propane tripelargonate and pentaerythritol tetrapelargonate), and the like, or any combination thereof.

Suitable emulsifiers for use in conjunction with the present invention may include, but not be limited to, sorbitan monolaurate, e.g., SPAN® 20 (available from Uniqema, Wilmington, Del.), or poly(ethylene oxide) sorbitan monolaurate, e.g., TWEEN® 20 (available from Uniqema, Wilmington, Del.).

Suitable vitamins for use in conjunction with the present invention may include, but not be limited to, vitamin B compounds (including B1 compounds, B2 compounds, B3 compounds such as niacinamide, niacinnicotinic acid, tocopheryl nicotinate, $C_1$-$C_{18}$ nicotinic acid esters, and nicotinyl alcohol; B5 compounds, such as panthenol or "pro-B5", pantothenic acid, pantothenyl; B6 compounds, such as pyroxidine, pyridoxal, pyridoxamine; carnitine, thiamine, riboflavin); vitamin A compounds, and all natural and/or synthetic analogs of Vitamin A, including retinoids, retinol, retinyl acetate, retinyl palmitate, retinoic acid, retinaldehyde, retinyl propionate, carotenoids (pro-vitamin A), and other compounds which possess the biological activity of Vitamin A; vitamin D compounds; vitamin K compounds; vitamin E compounds, or tocopherol, including tocopherol sorbate, tocopherol acetate, other esters of tocopherol and tocopheryl compounds; vitamin C compounds, including ascorbate, ascorbyl esters of fatty acids, and ascorbic acid derivatives, for example, ascorbyl phosphates such as magnesium ascorbyl phosphate and sodium ascorbyl phosphate, ascorbyl glucoside, and ascorbyl sorbate; and vitamin F compounds, such as saturated and/or unsaturated fatty acids; or any combination thereof.

Suitable antimicrobials for use in conjunction with the present invention may include, but not be limited to, antimicrobial metal ions, chlorhexidine, chlorhexidine salt, triclosan, polymoxin, tetracycline, amino glycoside (e.g., gentamicin), rifampicin, bacitracin, erythromycin, neomycin, chloramphenicol, miconazole, quinolone, penicillin, nonoxynol 9, fusidic acid, cephalosporin, mupirocin, metronidazolea secropin, protegrin, bacteriolcin, defensin, nitrofurazone, mafenide, acyclovir, vanocmycin, clindamycin, lincomycin, sulfonamide, norfloxacin, pefloxacin, nalidizic acid, oxalic acid, enoxacin acid, ciprofloxacin, polyhexamethylene biguanide (PHMB), PHMB derivatives (e.g., biodegradable biguanides like polyethylene hexamethylene biguanide (PEHMB)), clilorhexidine gluconate, chlorohexidine hydrochloride, ethylenediaminetetraacetic acid (EDTA), EDTA derivatives (e.g., disodium EDTA or tetrasodium EDTA), and the like, and any combination thereof.

Antistatic agents (antistats) for use in conjunction with the present invention may comprise any suitable anionic, cationic, amphoteric or nonionic antistatic agent. Anionic antistatic agents may generally include, but not be limited to, alkali sulfates, alkali phosphates, phosphate esters of alcohols, phosphate esters of ethoxylated alcohols, or any combination thereof. Examples may include, but not be limited to, alkali neutralized phosphate ester (e.g., TRYFAC® 5559 or TRYFRAC® 5576, available from Henkel Corporation, Mauldin, S.C.). Cationic antistatic agents may generally include, but not be limited to, quaternary ammonium salts and imidazolines which possess a positive charge. Examples of nonionics include the poly(oxyalkylene) derivatives, e.g., ethoxylated fatty acids like EMEREST® 2650 (an ethoxylated fatty acid, available from Henkel Corporation, Mauldin, S.C.), ethoxylated fatty alcohols like TRYCOL® 5964 (an ethoxylated lauryl alcohol, available from Henkel Corporation, Mauldin, S.C.), ethoxylated fatty amines like TRYMEEN® 6606 (an ethoxylated tallow amine, available from Henkel Corporation, Mauldin, S.C.), alkanolamides like EMID® 6545 (an oleic diethanolamine, available from Henkel Corporation, Mauldin, S.C.), or any combination thereof. Anionic and cationic materials tend to be more effective antistats.

To facilitate a better understanding of the present invention, the following examples of preferred embodiments are given. In no way should the following examples be read to limit, or to define, the scope of the invention.

EXAMPLES

Example 1

To combine two tow bands, a system was used that included a tow band processing line having three tow spreaders, a master air jet for receiving the tow bands from the tow band processing line, hand-held guidery between the first and second tow spreaders of the tow band processing line, and hand-held guidery between the tow band processing line and master air jet. Two tow bands were spread on the tow band processing lines then introduced in a stacked configuration into the master air jet. One tow band was colored while the other tow band was white. The produced bulked web produced has intermingling at the interface of the two tow bands and has sidedness with one side being substantially the colored tow band and the other side being substantially the white tow band. This example demonstrates the cross-sectional make-up of the bulked web is substantially the same as the composition and positional relationship of the processed tow bands as introduced into the master air jet.

Example 2

Figure 13A:
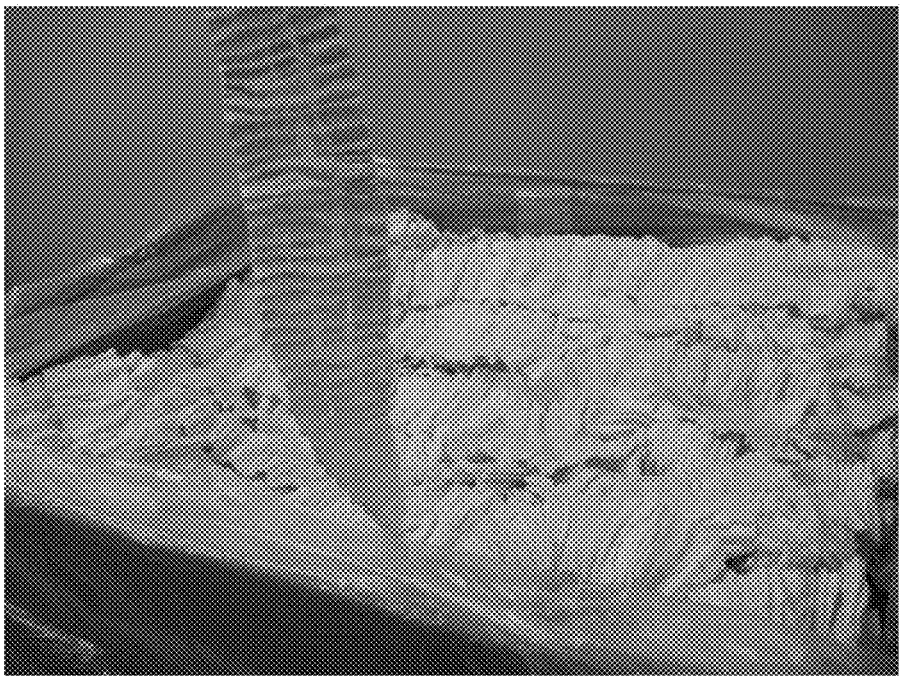
FIGS. 13A-D are pictures at various stages of processing a tow band along a nonlimiting embodiment of a system according to the present invention.
Figure 13B:
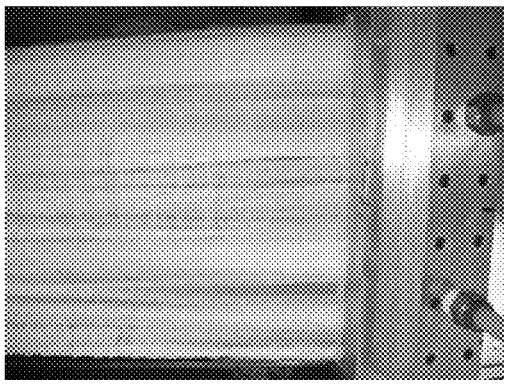
Figure 13C:
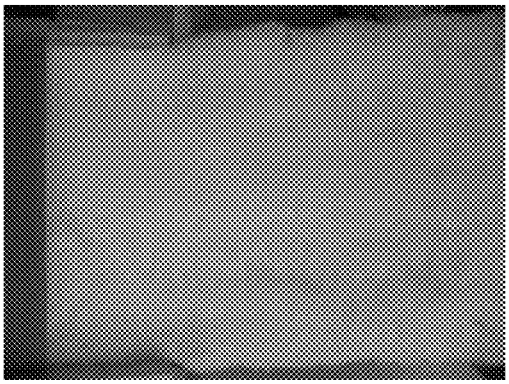
Figure 13D:
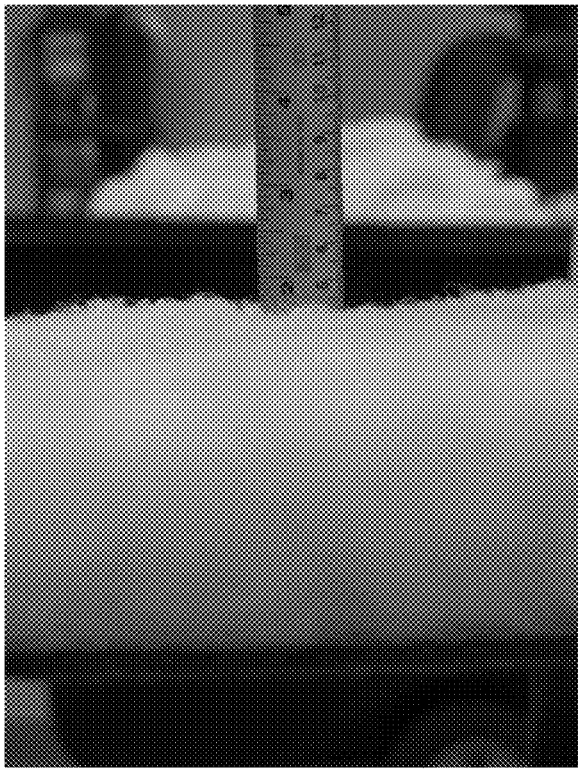

A polyester tow band having 280,000 total denier, 2.25 dpf, 44 crimps/10 cm, and a 4 inch width, shown in FIG. 13A was run along a tow band processing line having 3 spreaders and a delivery roll and into a master air jet. The master air jet had an inlet width of 250 mm, air pressure of 60 psig, inlet height of 10 mm, and outlet height of 39 mm. The bulked polyester tow band as introduced into the master air jet had substantially the same width, approximately 10 inches, as the bulked web exiting the master air jet, as shown in FIGS. 13B, and 13C, respectively. The produced bulked web had a caliper of about 4.5 cm as shown in FIG. 13D. It should be noted that the caliper of the resultant consolidated web was greater than the outlet height of the master air jet.

Example 3

Figure 14A:
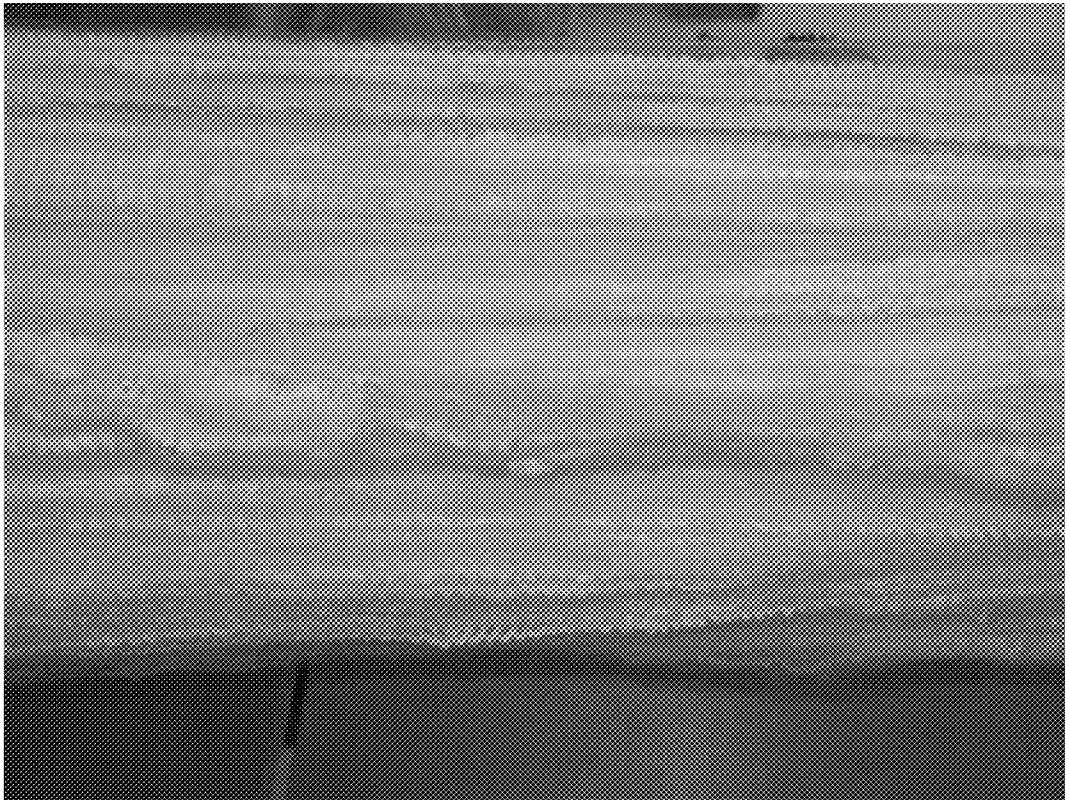
FIGS. 14A-B are pictures at various stages of processing a tow band along a nonlimiting embodiment of a system according to the present invention.
Figure 14B:
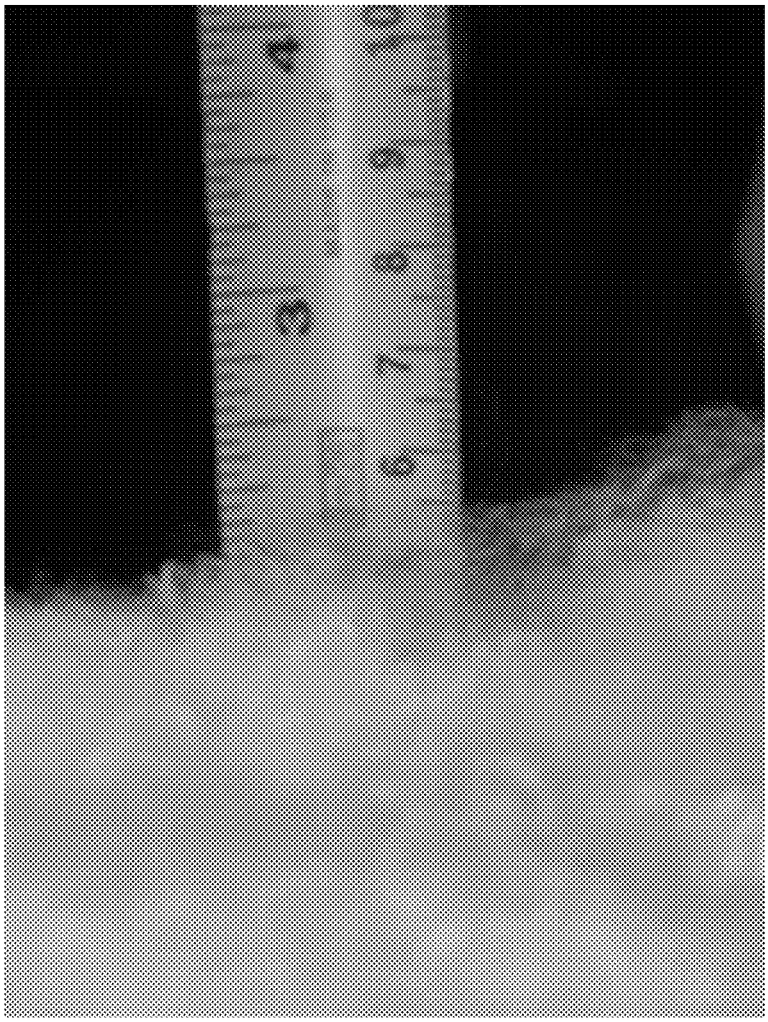

A section of 3,000,000 tow band was extracted yielding about a 200,000 total denier tow band. A lyocell tow band having a 24-inch substantially circular cross-section (as compared to the rectangular cross-section of Example 2) with a total denier of about 350,000, 3 dpf filaments, and 30 crimps/10 cm, shown after spreading in FIG. 14A, was processed through the same procedure as Example 2 to produce a bulked web having a caliper of about 5.5 cm as shown in FIG. 14B. It should be noted that similar to Example 2 the caliper of the resultant consolidated web was greater than the outlet height of the master air jet.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

introducing at least two processed tow bands into a master air jet;

producing a bulked web in the master air jet, wherein the bulked web has a width of about 50 cm or greater; and forming a nonwoven material from the bulked web.

2. The method of claim 1, wherein introducing the at least two processed tow bands is in a side-by-side configuration, and wherein the bulked web has a cross-sectional composition similar to that of the side-by-side configuration.

3. The method of claim 1, wherein the bulked web has a bulk density of about 0.05 g/cm$^3$ or less.

4. The method of claim 1, wherein the bulked web has a caliper of about 10 mm or greater.

5. The method of claim 1, wherein the bulked web has a width of about 1 m or greater.

6. The method of claim 1, wherein the nonwoven material has a bulk density of about 0.25 g/cm$^3$ or less.

7. The method of claim 1, wherein the nonwoven material has a caliper of about 0.5 mm or greater.

8. The method of claim 1, wherein the nonwoven material comprises at least one additive that comprises at least one selected from the group consisting of an active particle, an active compound, an ion exchange resin, a zeolite, a nanoparticle, a ceramic particle, an abrasive particulate, an absorbent particulate, a softening agent, a plasticizer, a pigment, a dye, a flavorant, an aroma, a controlled release vesicle, a binder, an adhesive, a tackifier, a surface modification agent, a lubricating agent, an emulsifier, a vitamin, a peroxide, a biocide, an antifungal, an antimicrobial, a deodorizer, an antistatic agent, a flame retardant, an antifoaming agent, a degradation agent, a conductivity modifying agent, a stabilizing agent, and any combination thereof.

9. The method of claim 1, wherein at least one processed tow band comprises filaments that comprise at least one selected from the group consisting of a polyolefin, a polyethylene, a polypropylene, a polyester, a polyethylene terphalate, a lyocell, a viscose, a rayon, a polyamine, a polyamide, a polypropylene oxide, a polyethylene sulfide, a polyphenylene sulfide, a liquid crystalline polymeric substance capable of being formed into fibers, a silk, a wool, a cotton, a polyacrylate, a polymethacrylate, a cellulose acetate, a cellulose diacetate, a cellulose triacetate, a cellulose propionate, a cellulose butyrate, a cellulose acetate-propionate, a cellulose acetate-butyrate, a cellulose propionate-butyrate, a starch acetate, an acrylonitrile, a vinyl chloride, a vinyl ester, a vinyl ether, any derivative thereof, any copolymer thereof, and any combination thereof.

10. A method comprising:

processing a plurality of tow bands along at least one tow band processing line to form a plurality of processed tow bands; and introducing at least two of the processed tow bands into a master air jet; and producing a bulked web in the master air jet, wherein the bulked web has a caliper of about 10 cm to about 50 cm.

11. The method of claim 10, wherein combining involves the plurality of processed tow bands in a stacked configuration, a side-by-side configuration, or a combination thereof.

12. The method of claim 10, wherein the bulked web has a bulk density of about 0.05 g/cm$^3$ or less.

13. The method of claim 10, wherein the bulked web has a width of about 50 cm or greater.

14. The method of claim 10 further comprising:

forming a nonwoven material from the bulked web.

15. The method of claim 14, wherein the nonwoven material has a bulk density of about 0.25 g/cm$^3$ or less.

16. The method of claim 10, wherein at least one tow band has a denier per filament of about 1 to about 50 and a total denier of about 10,000 to about 3,000,000.

17. The method of claim 10, wherein at least one tow band comprises filaments that comprise at least one selected from the group consisting of a polyolefin, a polyethylene, a polyprsopylene, a polyester, a polyethylene terphalate, a lyocell, a viscose, a rayon, a polyamine, a polyamide, a polypropylene oxide, a polyethylene sulfide, a polyphenylene sulfide, a liquid crystalline polymeric substance capable of being formed into fibers, a silk, a wool, a cotton, a polyacrylate, a polymethacrylate, a cellulose acetate, a cellulose diacetate, a cellulose triacetate, a cellulose propionate, a cellulose butyrate, a cellulose acetate-propionate, a cellulose acetate-butyrate, a cellulose propionate-butyrate, a starch acetate, an acrylonitrile, a vinyl chloride, a vinyl ester, a vinyl ether, any derivative thereof, any copolymer thereof, and any combination thereof.

18. A method comprising:

forming three processed tow bands along three tow band processing lines;

combining the three processed tow bands in a stacked configuration to form a bulked web with a master air jet, wherein a second tow processed tow band is disposed between a first processed tow band and a third processed tow band, wherein the second tow band has a different composition than the first processed tow band and the third processed tow band, and wherein the bulked web has a cross-sectional composition similar to the stacked configuration;

transporting the bulked web to a nonwoven manufacturing line; and producing a nonwoven material from the bulked web.

19. The method of claim 18, wherein the nonwoven manufacturing line comprises at least one selected from the group consisting of an additive application area, a calendaring area, a hydroentanglement area, a needlelooming area, a needlepunching area, a resin-bond area, a drying area, a heating area, a cooling area, a collection area, any hybrid thereof, and any combination thereof.

20. The method of claim 18, wherein the bulked web has a bulk density of about 0.05 g/cm$^3$ or less.

21. The method of claim 18, wherein the bulked web has a caliper of about 10 mm or greater.

22. The method of claim 18, wherein the bulked web has a width of about 50 cm.

23. The method of claim 18, wherein the nonwoven material has a bulk density of about 0.25 g/cm$^3$ or less.

24. The method of claim 18, wherein the nonwoven material has a caliper of about 0.5 mm or greater.

25. The method of claim 18, wherein at least one tow band has a denier per filament of about 1 to about 50 and a total denier of about 10,000 to about 3,000,000.

* * * * *